US012110761B2

(12) United States Patent
Evans et al.

(10) Patent No.: US 12,110,761 B2
(45) **Date of Patent: *Oct. 8, 2024**

(54) HYDROSTATICALLY INSENSITIVE TESTING AND INJECTION PLUG

(71) Applicant: Weatherford Technology Holdings, LLC, Houston, TX (US)

(72) Inventors: Eric R Evans, Magnolia, TX (US); Jobby T. Jacob, Sugar Land, TX (US); Joshua V. Symms, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/131,167

(22) Filed: Apr. 5, 2023

(65) Prior Publication Data

US 2024/0229598 A1 Jul. 11, 2024

Related U.S. Application Data

(63) Continuation-in-part of application No. 18/152,737, filed on Jan. 10, 2023.

(51) Int. Cl.

| | |
|---|---|
| ***E21B 33/16*** | (2006.01) |
| ***E21B 34/10*** | (2006.01) |
| ***E21B 34/14*** | (2006.01) |
| ***E21B 47/117*** | (2012.01) |

(52) U.S. Cl.

CPC ..... *E21B 33/16* (2013.01); *E21B 34/101* (2013.01); *E21B 34/14* (2013.01); *E21B 47/117* (2020.05); *E21B 2200/06* (2020.05)

(58) Field of Classification Search

CPC ..... E21B 33/16; E21B 33/165; E21B 33/167

See application file for complete search history.

(56) References Cited

U.S. PATENT DOCUMENTS

| | | | | |
|---|---|---|---|---|
| 2,997,070 | A | 8/1961 | Penhale | |
| 3,228,473 | A | 1/1966 | Baker | |
| 4,164,980 | A | 8/1979 | Duke | |
| 4,671,358 | A * | 6/1987 | Lindsey, Jr. ..... | E21B 34/14 166/291 |
| 5,181,571 | A | 1/1993 | Mueller et al. | |
| 5,191,932 | A | 3/1993 | Seefried et al. | |
| 7,128,154 | B2 | 10/2006 | Giroux et al. | |
| 7,234,529 | B2 | 6/2007 | Surjaatmadja | |

(Continued)

OTHER PUBLICATIONS

Weatherford; Casing Wiper Plugs and Darts, copyright 2013, 58-pages.

(Continued)

*Primary Examiner* — David Carroll

(74) *Attorney, Agent, or Firm* — Cabello Hall Zinda, PLLC

(57) ABSTRACT

A plug for use in a wellbore has a piston that is movable on a body. A control valve is disposed in communication between the wellbore and a piston chamber and can capture wellbore pressure in the piston chamber. A closure on the body can transition from a closed condition to an open condition relative to the port in response to the movement of the piston. A fixture releasably holds the closure in the closed condition on the body. The fixture releases in response an increased pressure differential on the piston above an initial pressure differential between the captured chamber pressure and the wellbore pressure.

22 Claims, 19 Drawing Sheets

(56) References Cited

U.S. PATENT DOCUMENTS

| | | | | |
|---|---|---|---|---|
| 8,201,634 | B2 | 6/2012 | Laurel et al. | |
| 8,807,227 | B2 | 8/2014 | Fould et al. | |
| 9,080,422 | B2 | 7/2015 | Melenyzer | |
| 9,273,534 | B2 | 3/2016 | Merron et al. | |
| 10,156,124 | B2 | 12/2018 | Guzman et al. | |
| 10,246,968 | B2 | 4/2019 | Budde et al. | |
| 10,260,306 | B1 | 4/2019 | Beckett et al. | |
| 10,648,272 | B2 | 5/2020 | Budde et al. | |
| 10,954,740 | B2 | 3/2021 | Budde et al. | |
| 11,047,202 | B2 | 6/2021 | Budde et al. | |
| 11,047,227 | B1 | 6/2021 | Warlick | |
| 11,401,778 | B1 | 8/2022 | Saraya | |
| 2003/0070816 | A1 | 4/2003 | Sullaway et al. | |
| 2003/0230405 | A1 | 12/2003 | Allamon et al. | |
| 2004/0031605 | A1 | 2/2004 | Mickey | |
| 2008/0251253 | A1* | 10/2008 | Lumbye | E21B 33/16 166/317 |
| 2012/0234561 | A1* | 9/2012 | Hall | E21B 23/02 166/386 |
| 2014/0060848 | A1 | 3/2014 | McMiles | |
| 2014/0138097 | A1 | 5/2014 | Andrigo | |
| 2016/0208578 | A1* | 7/2016 | Guzman | E21B 34/10 |
| 2017/0159408 | A1 | 6/2017 | Boutin et al. | |
| 2018/0112487 | A1* | 4/2018 | Budde | E21B 33/165 |
| 2019/0186228 | A1 | 6/2019 | Beckett et al. | |
| 2022/0136360 | A1 | 5/2022 | Buckland | |
| 2022/0228461 | A1 | 7/2022 | Sims et al. | |

OTHER PUBLICATIONS

Weatherford; Multiple Latch-In Plug System, copyright 2008-2013, 3 pages.

Weatherford; Multiple Latch-In Plugs, copyright 2008-2013, 3-pages.

* cited by examiner

HYDROSTATICALLY INSENSITIVE TESTING AND INJECTION PLUG

CROSS-REFERENCE TO RELATED APPLICATIONS

This a continuation-in-part of U.S. application Ser. No. 18/152,737 filed Jan. 10, 2023, which is incorporated herein by reference in its entirety.

TECHNICAL FIELD

The present disclosure relates to plug assemblies for use in operations in a wellbore, and more particularly, for plug assemblies providing for pressure management in a chamber of the plug assembly during operation.

BACKGROUND OF THE DISCLOSURE

In well completion operations, a wellbore is formed by drilling to access hydrocarbon-bearing formations. After drilling to a predetermined depth, the drill string and drill bit are removed, and a section of casing (or liner or pipe or tubular) is lowered into the wellbore. An annular area is formed between the string of casing and the formation, and a cementing operation may then be conducted to fill the annular area with cement to prevent the casing from moving within the wellbore and to isolate other formations from the hydrocarbon-bearing formations. In addition to preventing the casing from moving within the wellbore, the cemented annulus also provides for a stronger wellbore for facilitation of hydrocarbon production.

When the casing is sent downhole, the casing is typically filled with a fluid, such as drilling mud, and the fluid is maintained at a predetermined pressure. The fluid within the casing ensures that the casing does not collapse within the wellbore. A bottom end of the casing can include a float assembly, such as a float collar or a float shoe. The float assembly includes one or more unidirectional check valves that allow fluid to pass from the casing to the annulus but prevents fluid from the annulus entering the casing. An upper end of the float assembly may also include a receptacle for receiving a device, such as a cement plug, which is run or pumped down the casing.

During a cementing operation, it is preferred that the various fluids, such as spacer fluid, cement, displacement fluid and the like, are isolated or separated from one another within the casing. When fluids such as drilling mud mix with cement, for example, it can cause the cement to sour and fail when it sets. Accordingly, one or more plugs can be sent down, separating the fluids during a cementing operation. A plug includes one or more fins around its circumference which act to separate the fluids above and below the plug. The fins also clean the inner walls of the casing as the plug descends. Because the plug provides both separation and cleaning functions, the outer diameter of the plug is approximately equal to the inner diameter of the casing and sealingly engages the casing. As the plug descends, the fluid below the plug is forced by the plug and the fluid behind it through a float assembly and out into the annulus. A check valve within the float assembly prevents the fluid from moving back into the casing.

Although plugs may be solid, blocking fluid flow through the casing, some plugs may include a longitudinal bore therethrough. The bore may be selectively and temporarily blocked by a rupture membrane or the like, radially positioned across the bore to prevent the fluids above and below the plug from comingling. Once the plug reaches the float assembly, hydrostatic pressure is built above the rupture membrane. At rupture pressure, the membrane ruptures allowing fluid flow through the bore of the plug, through the float assembly, and into the annulus.

Multiple plugs may be employed in a cementing operation. For example, a first plug may push a first fluid, located below the plug, out into the casing annulus, while a second plug pushes a second fluid, such as a spacer fluid or cement, out into the annulus. The plugs are typically pumped down using a displacement fluid, for example, drilling mud or the like. In some embodiments, the multiple plugs are locked together upon landing. Typically, one of the plugs forms a seal within the casing, preventing fluid from moving past the plug. Once the wellbore is sealed, the cement is given time to cure and set.

A tubing string cemented in a borehole must withstand the pressures in which the tubing string is designed to be used. For this reason, operators want to test the integrity of the tubing string once the tubing is cemented in the borehole. Generally, a casing integrity test would be performed after placement of cement. This requires the ability to seal the casing for the test and then to open full communication below the shoe after the test. For instance, the casing can be set horizontally through a production zone, and a casing integrity test is performed.

In a casing integrity test, the cemented casing is pressure tested by injecting a displacement fluid, such as drilling fluid, into the casing up to a desired internal casing pressure. Testing is typically performed with a plug blocking fluid flow at the bottom of the casing. After integrity testing, reestablishing fluid communication with the wellbore required drilling out the plug or running a casing perforation operation, both lengthy and costly processes.

After the casing integrity test, for example, operators need to deploy perforation guns into the horizontal zone to perforate holes through the casing for production. The perforation guns are not able to be lowered through the horizontal section of the casing without the use of wireline tractors, which can be expensive and time consuming. It is much more efficient and cost effective to pump the perforation guns downhole to the shoe if the casing is allowed to be reopened after the casing integrity test. While pumping the perforation guns downhole, the fluid ahead of the perforation guns can be injected into the formation.

Unfortunately, performing a full pressure check on the tubing string is not always possible after completing a cementing operation. For example, the testing process can be performed by deploying a plug, such as a ball, down the tubing string, landing the ball on a seat downhole, and increasing the tubing pressure behind the seated ball up to a particular test level. A drill bit may then need to be run back down the casing so the drill bit can drill out any landing balls, seats, and the float shoe. This process can be very time-consuming. Moreover, cement may be placed with a wet shoe condition on horizontal production casing or liner strings so fluid communication to the formation can be achieved within the shoe track. A toe sleeve, or other means of opening a flow port within the shoe track, is then activated at a pre-determined pressure that is greater than the planned casing integrity test pressure. Successfully performing a pressure test for a wet shoe implementation with a toe sleeve within the shoe track may not be directly possible or feasible. In this and other situations, operators may not be able to perform a full pressure check on the casing.

The subject matter of the present disclosure is directed to overcoming, or at least reducing the effects of, one or more of the problems set forth above.

SUMMARY OF THE DISCLOSURE

A device disclosed herein is for use in a wellbore. The device comprises a body, a piston, a control valve, a closure, and a fixture. The body defines a passage extending between a port and an opening. The piston is movable on the body from a first condition to a second condition and has a piston chamber. The control valve is disposed in communication between the wellbore and the piston chamber and is configured to capture wellbore pressure in the piston chamber as captured chamber pressure. The closure is disposed on the body and is configured to transition from a closed condition to an open condition relative to the port in response to the movement of the piston. The closure in the closed condition prevents fluid communication through the passage, and the closure in the opened condition permits fluid communication through the passage. The fixture releasably holds the closure in the closed condition on the body. The fixture is configured to release in response to an increased pressure differential on the piston above an initial pressure differential between the captured chamber pressure and the wellbore pressure.

For the device, the body can be used for a wiper plug. For example, the body can have first and second ends. The first end can have the opening, and the second end can have the port. The first end is configured to removably affix to a wiper plug. In fact, the device can further include a wiper plug having a head and a tail and defining an internal bore therethrough. The body of the device can be removably affixable to the tail of the wiper plug, and the head of the wiper plug can comprise a seal and a catch configured to engage in a seat. Finally, the device can be a wiper plug. For example, the body can have a wiper fin disposed thereabout and can have a head and a tail, respectively having the opening and the port of the body.

A system is disclosed herein for cementing tubing in a wellbore. The tubing has a landing at a toe thereof. The system comprises first and second plugs. The first plug is deployable in the tubing, and the second plug is deployable in the tubing after the first plug. The first plug defines a bore from a head to a tail, and the head is configured to engage with the landing. The second plug has a device as discussed above. The second plug is configured to engage with the tail of the first plug.

A plug disclosed herein is for use in a wellbore. The plug comprises a body, a piston housing, a control valve, a closure, a biasing element, and a fixture. The body has a head and a tail, and the body defines a passage extending from a port toward the tail to an opening toward the head. The piston housing is movably disposed on the tail of the body from a first condition to a second condition and encloses a piston chamber therewith. The control valve is disposed in communication with the piston chamber and is configured to control pressure communication between wellbore and the piston chamber. The piston housing is urged from the first condition to the second condition in response to a pressure differential between chamber pressure in the pressure chamber and wellbore pressure in the wellbore. The closure is movable from a closed condition to an open condition relative to the port. The closure in the closed condition prevents fluid communication through the passage, and the closure in the opened condition permits fluid communication through the passage. The biasing element is disposed between the piston housing and the closure. The biasing element biases the closure toward the open condition and biases the piston housing toward the second condition. The fixture releasably affixes the closure to the piston housing. The fixture initially holds the closure in the closed condition and prevents the movement of the piston housing from the first condition to the second condition. The fixture is configured to release in response to the movement of the piston housing from the first condition to the second condition due to the pressure differential increased above an initial level.

A plug disclosed herein is for use in a wellbore. The plug comprises a body, a piston housing, a control valve, a closure, a biasing element, and a fixture. The body has a head and a tail, and the body defines a passage extending from a port toward the tail to an opening at the head. The piston is movably disposed on the tail of the body. The piston has a closure portion and a housing portion. The housing portion defines a piston chamber with a portion of the body, and the closure portion is movable from a closed condition to an open condition relative to the port. The closure portion in the closed condition prevents fluid communication through the passage, and the closure portion in the opened condition permits fluid communication through the passage. The control valve is disposed in communication with the piston chamber and is configured to control pressure communication between the wellbore and the piston chamber. The closure portion of the piston is urged from the closed condition to the opened condition in response to a pressure differential between chamber pressure in the pressure chamber and wellbore pressure in the wellbore. The biasing element is disposed between the piston and the body. The biasing element biases the closure portion toward the open condition. The fixture releasably affixes the piston to the body with the closure portion initially held in the closed condition. The fixture is configured to release in response to the movement of the piston due to the pressure differential increased above an initial level.

A method is disclosed for cementing tubing in a wellbore during a cementing operation. The method comprises: landing a plug in the tubing during the cementing operation, the plug having a closure, a pressure chamber, and a fixture; performing a pressure test by increasing tubing pressure in the tubing behind the landed plug and preventing, with the closure in a closed condition, communication through a passage in the landed plug; controlling communication of the tubing pressure to the pressure chamber on the plug; releasing a fixture in response to movement of the pressure chamber from a first condition to a second condition due to an increased pressure level in the pressure chamber; and permitting communication through the passage in the plug by permitting the closure to move from the closed condition to the opened condition in response to the release of the fixture.

The foregoing summary is not intended to summarize each potential embodiment or every aspect of the present disclosure.

BRIEF DESCRIPTION OF THE DRAWINGS

Drawings of the preferred embodiments of the present disclosure are attached hereto so that the embodiments of the present disclosure may be better and more fully understood.

DETAILED DESCRIPTION OF THE DISCLOSURE

Figure 1:
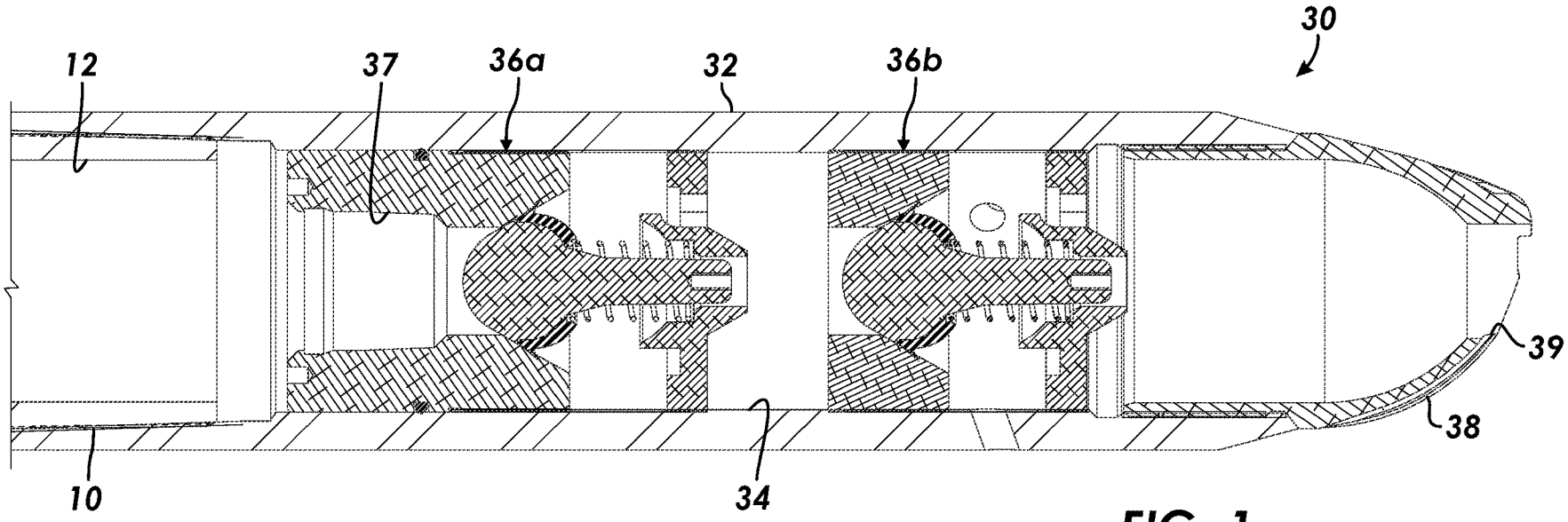
FIG. 1 illustrates a cross-sectional view of a landing collar for a system according to the present disclosure.
Figure 2:
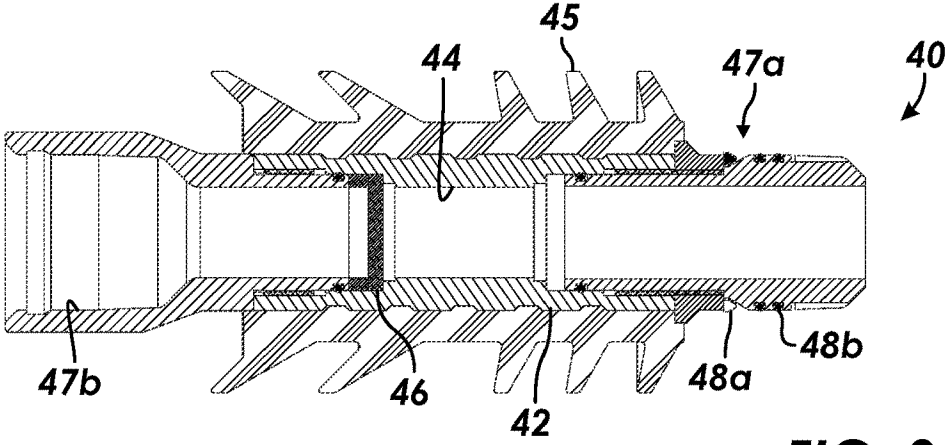
FIG. 2 illustrates a cross-sectional view of a first type of wiper plug for the system of the present disclosure.
Figure 3A:
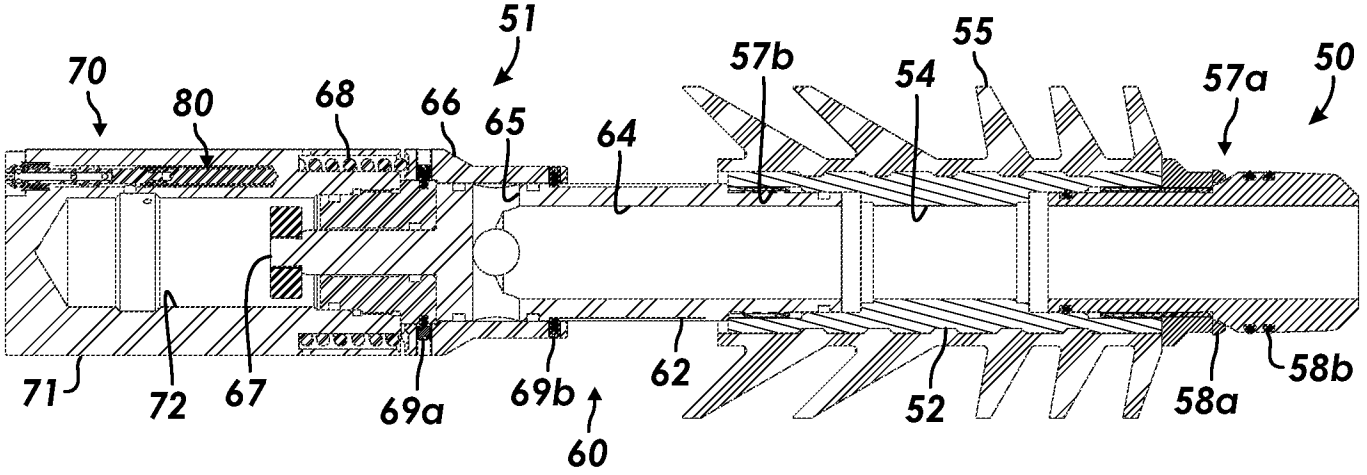
FIGS. 3A-3B illustrate a cross-sectional view and an elevational view of a second type of wiper plug for the system of the present disclosure.
Figure 3B:
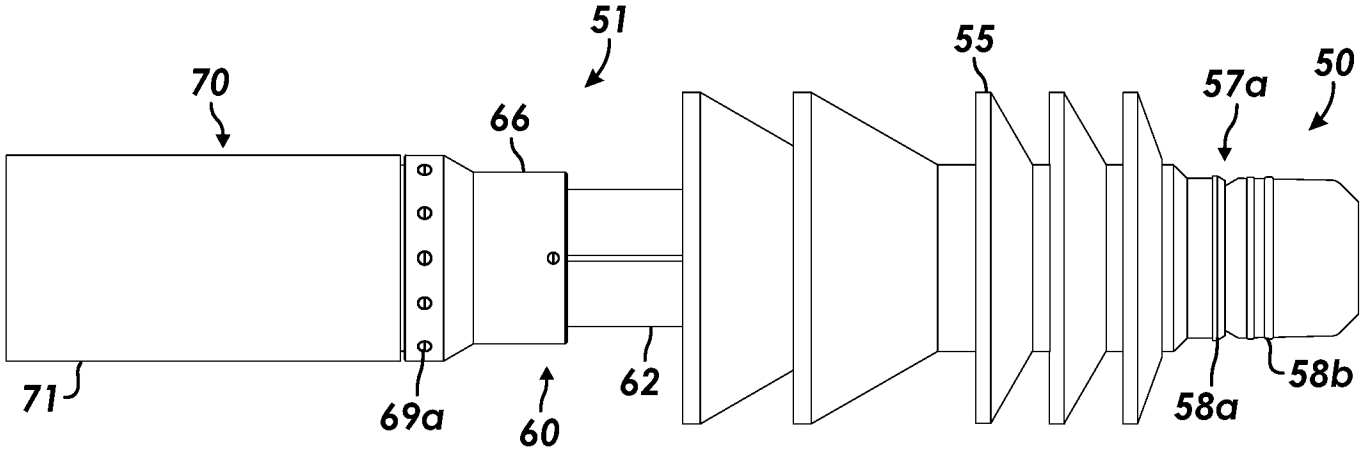

FIGS. 1 through 3B illustrate components for a system according to the present disclosure. The components can include a landing collar (FIG. 1), a first plug assembly (FIG. 2), and a second plug assembly (FIGS. 3A-3B). As shown in FIG. 1, the landing collar 30 includes a housing 32 and a landing or seat 37. The housing 32 couples to a tubing string 20 for a completion installation. As discussed below, the seat 37 allows a deployed plug to latch and seal.

In general, the landing collar 30 can be considered a float collar, a float shoe, a float assembly, or any other piece of equipment that seals with a plug deployed downhole and may also latch with that plug. The landing collar 30 can include a one-way valve or a check valve, such as a float valve. As shown here, the landing collar 30 can be a float collar having dual check valves 36*a-b* and a toe shoe 38. The check valves 36*a-b* in the bore 34 of the housing 32 allow fluid communication from the tubing string's bore 22 to the opening 39 in the toe 38, but prevent fluid communication in the opposite direction. The dual-valve arrangement provides redundant control of possible backpressure. Although the assembly is described as including check valves 36*a-b* in the landing collar 30, the assembly can instead simply use a landing collar that has a landing 37 in the housing 32 and that lacks a float valve arrangement.

As shown in FIG. 2, the first plug assembly (i.e., bottom wiper plug) 40 includes a body 42 having an internal passage or bore 44. Fins 45 are disposed on the outside of the body 42 to engage inside the tubing string's bore through which the first wiper plug 40 passes. A temporary barrier 46 is disposed in the plug's passage 44 to prevent fluid communication until the barrier 46 is removed. The temporary barrier 46 can be a rupture disk, a breachable element, a removable seal, a valve, or the like. Finally, the end of the body 42 includes a head 47*a* for seating in a seat (37; FIG. 1) of the landing collar (30). The head 47*a* includes a latching or retaining mechanism, such as a lock or snap ring 48*a*, and one or more seals 48*b* for engagement.

Although the system is described as including a bottom wiper plug 40, use of such a plug may be optional depending on the implementation for a particular cementing operation. For some cementing operations, the bottom wiper plug 40 can separate an advancing cement slurry from a following retarding fluid pumped down the tubing string 20. In other operations, the bottom wiper plug 40 can separate an advancing spacer fluid from a following cement slurry pumped down the tubing string 20. In still other operations, the bottom wiper plug 40 may not be used.

As shown in FIGS. 3A-3B, the second plug assembly (i.e., the top wiper plug) 50 includes a body 52 having an internal passage or bore 54. Fins 55 are disposed on the outside of the body 52 to engage inside the tubing string's bore through which the top wiper plug 50 passes. The end of the body 52 includes a head 57*a* for seating in a seat (47*b*; FIG. 2) of the bottom wiper plug (40). Alternatively, the head 57*a* can be used for seating in the seat (37; FIG. 1) of the landing collar if a bottom plug (40) is not used. The head 57*a* includes a latching or retaining mechanism, such as a lock or snap ring 58*a*, and one or more seals 58*b* for engagement.

The top wiper plug 50 with its body 52, passage 54, etc. is similar to the bottom wiper plug 40, except that the top wiper plug 50 includes a valve unit 51 having a closure 60 and a piston 70 disposed on the body 52. The valve unit 51 includes a valve body or body extension 62, a sleeve 66, and a biasing element 68 for the closure 60. The body extension 62 has a passage 64 in communication with the body's passage 54, and side ports 65 are defined in the body extension 62 to communicate with the extension's passage 64. As shown here in this embodiment, the valve body or body extension 62 is affixed in a seating area 57*b* of the body 52 so that the elements 52, 62 form an overall body of the plug 50, and the passages 54, 64 extending through the plug 50 from the ports 65 to the opening at the head 57*a* form an overall passage through the body of the plug 50. Although shown as having separate, connected elements 52, 62, the valve body or body extension 62 in some embodiments is integrated with the plug's body 52. Therefore, the body of the plug 50 can be an integral component or can be comprised of several connected elements.

In general, the closure 60, which includes the sleeve 66, is configured to transition from a closed condition to an open condition relative to the ports 65. The closure 60 in the closed condition prevents fluid communication through the passage 54, 64 by covering and sealing off the ports 65, while the closure 60 in the opened condition permits fluid communication through the passage 54, 64 by uncovering the ports 65.

The piston 70 has a piston housing 71 and a control valve or valve sub-assembly 80. The piston housing 71 is movably disposed on a stem 67 extending from the tail end of the extension 62, and the piston housing 71 encloses a piston chamber 72. Various seals are provided between elements of the piston housing 71 and the stem 67 so isolated pressure can be contained in the pressure chamber 72.

The control valve 80 is disposed on the piston housing 71 and is configured to capture wellbore pressure in the piston chamber 72. Meanwhile, a releasable fixture 69*a-b* releasably holds the closure 60 in the closed condition on the body 52, 62. As discussed below, the fixture 69*a-b* is configured to release in response an increased pressure differential of the piston 70 above an initial pressure differential between the captured chamber pressure and surrounding wellbore pressure.

The releasable fixture 69*a-b* shown here includes one or more shearable pins or screws 69*a* and one or more guide pins or set screws 69*b*. The set screws 69*b* are installed into grooves on the outside diameter of the body extension 62 and prevent the sleeve 66 from travelling upwards. Once the shearable screws 69*a* are sheared, the sleeve 66 travels down due to the biasing element 68 uncompressing. The set screws 69*b* travel down following the grooves located within the body extension 62.

As shown, the sleeve 66 is disposed on the outside of the extension 62, and the biasing member or spring 68 on the extension 62 urges against the sleeve 66 and the piston housing 71. When the sleeve 66 is held by the shear pins 69*a* engaged with the housing 71, the sleeve 66 seals with O-rings on the extension 62 and closes off the side ports 65 to prevent fluid communication.

Pressure within the piston chamber 72 is controlled by the control valve 80 on the piston housing 71. (Details of the control valve 80 are described below with reference to FIGS. 6A to 7B.) In general, the control valve 80 is open and allows wellbore pressure into the chamber 72. At a predetermined pressure level, the control valve 80 closes and captures pressure in the chamber 72. When a differential pressure captured in the piston chamber 72 exceeds a predefined threshold, the piston 70 is urged away from the body. The guide pins 69*b* initially prevent movement of the piston 70. However, the shear pins 69*a* holding the sleeve 66 eventually shear, and the spring 68 urges the sleeve 66 open relative to the ports 65, which allows fluid communication through the passages 64, 54 of the wiper plug 50.

This wiper plug 50 is used in the assembly for pressure testing after cementing the tubing string 20 in the borehole. For some cementing operations, the wiper plug 50 can separate an advancing retarding fluid from a following displacement fluid pumped down the tubing string 20, such as when a bottom wiper plug (40) is used for separating the cement slurry from the retarding fluid. In other operations, the wiper plug 50 can separate an advancing cement slurry from a following displacement fluid pumped down the tubing string 20. These and other options can be used depending on the implementation.

Figure 4A:
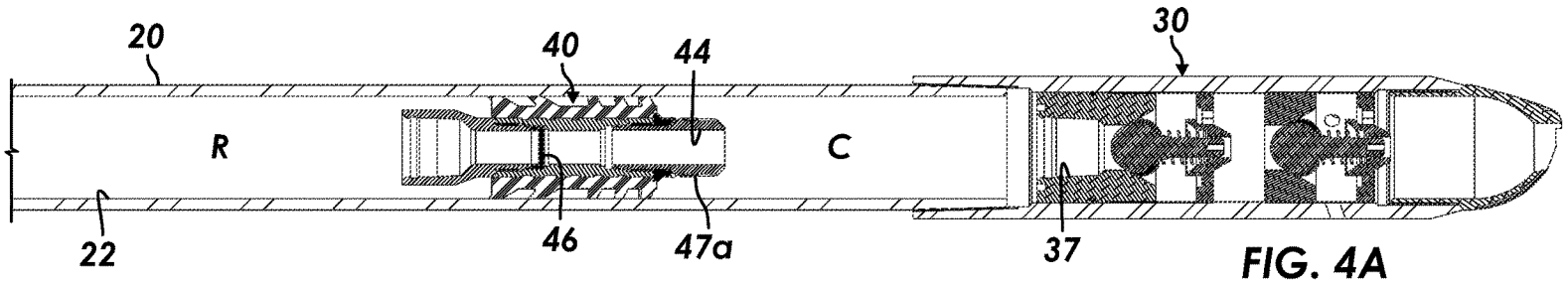
FIGS. 4A-4D illustrate components of the system during stages of an example cementing operation according to the present disclosure.

Having an understanding of the components of the disclosed assembly, FIGS. 4A-4D illustrate the assembly during stages of an example cementing operation. As shown in FIG. 4A, the landing collar 30 is disposed on the toe of a tubing string 20 to be cemented in a wellbore (not shown). The tubing string 20 referred to herein may be casing, production tubing, liner, tubulars, or the like. Initially, mud can be pumped down the tubing 20 and out of the landing collar 30 so the mud can travel back up the annulus to clear the borehole.

During a first stage of the cementing operations shown in FIG. 4A, a cement slurry (C) is pumped down the tubing string 20 followed by the bottom wiper plug 40. As will be appreciated, cementation equipment (not shown) is typically used at surface for pumping fluid and deploying plugs. For example, the bottom wiper plug 40 is launched from a cementing head following the advancing cement slurry and is followed by a following retarding fluid through the tubing 20 while preventing cement contamination while being pumped downhole.

The bottom wiper plug 40 is pumped until it lands in the landing 37 of the landing collar 30. Preferably, the landing 37 and the plug 40 include a latch and seal mechanism to retain and seal the wiper plug 40 when landed. For example, the head 47*a* can seal and lock in the seat 37 of the landing collar 30. The passage 44 through the bottom wiper plug 40 has the temporary barrier 46, which can then be opened by pressure. For example, the barrier 46 can be a breachable element, such as a rupture disc, or can be a valve or the like. Pressure pumped behind the barrier 46 eventually opens the barrier 46 (e.g., ruptures the disc), allowing for fluid communication through the bottom wiper plug 40 to the landing collar 30.

For example, the barrier 46 can be ruptured, breached, or otherwise removed by application of a predetermined pressure against the barrier 46. When the barrier 46 is opened, the retarding fluid (R) pumped down through the bore 22 of the tubing string 20 can now pass through the bottom wiper plug 40, out the landing collar 30, and into the annulus of the borehole.

As will be appreciated, the removal of the barrier 46 is designed to not damage or hinder operation of the landing collar 30. Accordingly, proper selection of the barrier 46 is made. As also disclosed, it is feasible for the bottom wiper plug 40 to have only one barrier 46 as long as removal can be assured. In an alternative arrangement, the bottom wiper plug 40 can have two barriers 46 enclosing a lower pressure chamber inside the plug 40, which can help ensure proper opening. Details are disclosed in U.S. application Ser. No. 17/530,730 filed Nov. 19, 2021, which is incorporated herein by reference.

Figure 4B:
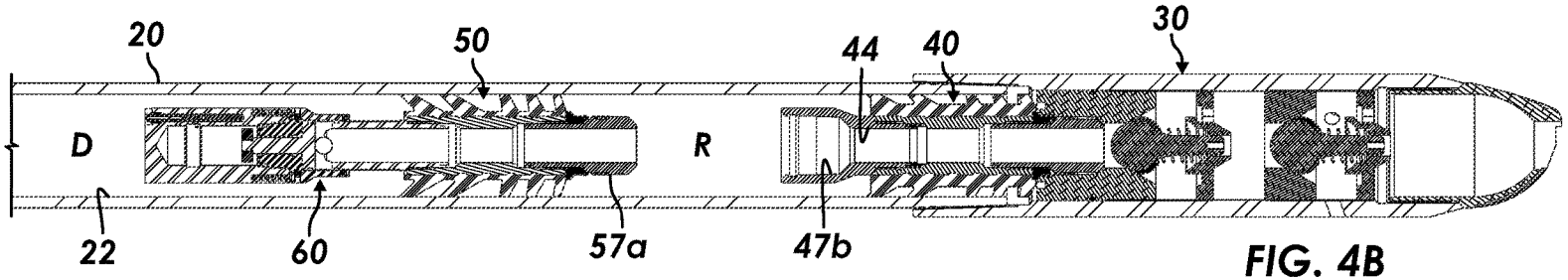

Eventually in the cementing operation as shown in FIG. 4B, the top wiper plug 50 is launched and is pumped down the tubing bore 22 behind the retarding fluid (R) using a displacement fluid (D). The top wiper plug 50 can act as a stinger dart that is pumped behind the cement slurry (C) and retarding fluid (R) and wipes the inside of the tubing 20, providing a mechanical barrier between the cement (C) and the displacement fluid (D). During travel downhole, the closure 60 of the top wiper plug 50 is closed.

Figure 4C:
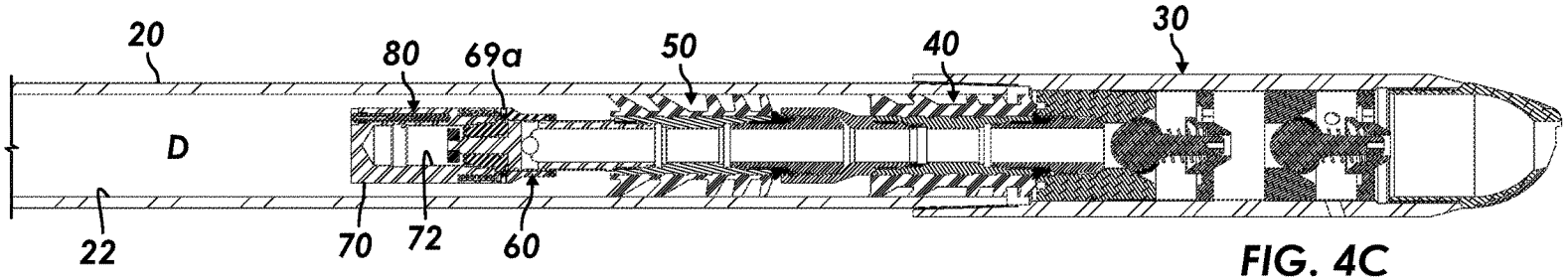

Eventually, as shown in FIG. 4C, the top wiper plug 50 reaches the bottom wiper plug 40 and lands in the bottom wiper plug 40 to close off the fluid passage through the bottom wiper plug 40. Again, a latch and seal mechanism between the plugs 40, 50 can retain and seal the wiper plug 50 when landed. For example, the head 57*a* of the top wiper plug 50 fits (seals and locks) into the plug's seat 47*b* and can latch therein.

During the cementing operation, the cement slurry is forced up the annulus between the tubing string 20 and borehole so the tubing string 20 can be fixed in place once the cement (C) eventually hardens. Before the cement hardens, the retarding fluid (R), however, can flow through the bottom wiper plug(s) 40, out the landing collar 30, and into the toe of the borehole. The retarding fluid (R) retards the hardening of the cement slurry (C) at the toe so fluid communication with the borehole can be achieved after cementation. In this case, operators may use a "wet shoe" at the end of tubing string 20 where the cement (C) does not set around or obstruct the landing collar 30 at the end of the tubing string 20. After cementing, fluid communication can remain established through the tubing string 20 and the landing collar 30 into the borehole. In this way, the wet shoe enables operators to conduct subsequent operations after cementing, such as pumping down plugs or perforating guns to the toe of the tubing string 20.

During the eventual production operations, the tubing string 20 must withstand pressures for which the tubing string 20 is designed to be used. In conventional practice, testing the integrity of the tubing string 20 can be performed using a self-removing plug, such as a ball, deployed down the tubing string 20 and landed on a seat of a final wiper plug. When completing the wet shoe application, however, performing a full pressure check on the tubing string 20 is not always feasible using such a deployed plug. For this reason, a full pressure check may not be performed in conventional implementations. As will be appreciated, however, the tubing string 20 is subject to pressure changes and cycles during its operational life, and the structural integrity of the tubing string 20 must be maintained. Therefore, being able to the check the integrity of the tubing string 20 with a pressure check is preferred.

With the top wiper plug 50 engaged in the seat 47*b* of the bottom wiper plug 40 to close off fluid communication, a pressure integrity test can be performed on the tubing string 20 while the closure 60 remains closed. In the test as shown in FIG. 4C, the displacement fluid (D) is pumped behind the wiper plug 50 to build up pressure in the tubing string 20 cemented in the borehole to test the cementing operation. The wiper plug 50 holds the pressure so that the test pressure can be reached. The control valve 80 allows pressure to be communicated into the piston chamber 72 of the piston 70. Once the test pressure level is reached in the tubing 20, the control valve 80 closes, and increased pressure is captured in the piston chamber 72. As the wellbore pressure is reduced, an increased pressure differential is formed between the captured pressure in the piston chamber 72 and the wellbore pressure.

Figure 4D:
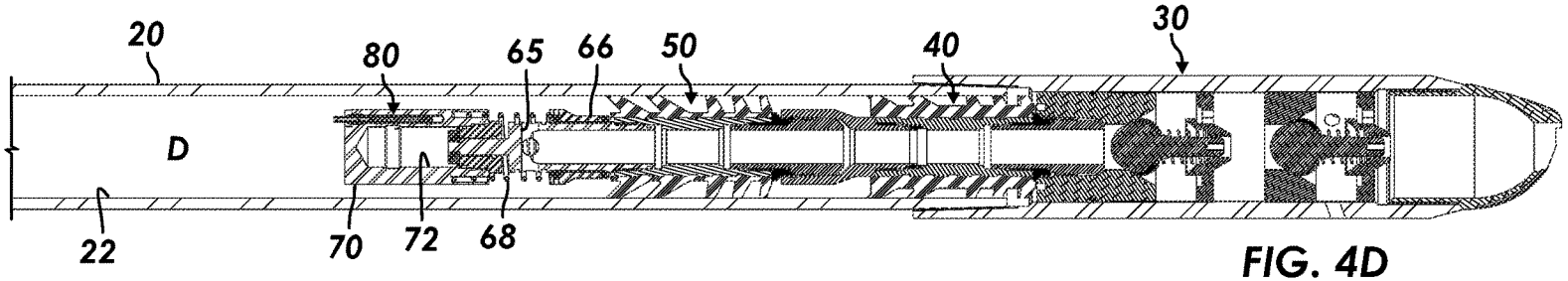

Eventually, as shown in FIG. 4D, the fixture (i.e., shear pins 69*a*) will release the closure 60, and the closure 60 (i.e., the sleeve 66) will open so fluid communication can be established through the ports 65, the plugs 40 and 50, and the landing collar 30 to the toe of the borehole. This fluid communication allows tools to be pumped down the tubing string 20 so further completion operations can be performed.

As can be seen, pressure applied against the top wiper plug 50 can be used to test the integrity of the cemented tubing string 20 to desired test levels. A full pressure check can be completed by allowing operators to cycle and monitor pressure pumped in the tubing string 20 behind the seated top plug 50 to assess the integrity of the tubing string 20. In turn, the closure 60 is set to open once the testing is complete.

Ultimately, for example, pressure is increased so that the valve sleeve 66 on the top wiper plug 50 is released and can shift so fluid can communicate through the ports 65 and through the plugs 50, 40 to pass to the landing collar 30. Fluid is allowed to bypass through the plugs 40, 50 and out the landing collar 30, which can have a desired shoe track beyond the toe of the tubing string 20. The closure 60, the piston 70, and the control valve 80 function without a need for any significant volumetric changes to be made to the chamber 72 or the passages (54, 64) of the plugs (40, 50). (There may be a slight volumetric change to the chamber 72 during the bleed down of the casing test.) Instead, the closure 60, the piston 70, and the control valve 80 function by only requiring pressure to be added to the chamber 72 during the testing. This decreases the differential pressure. Once the test pressure in the tubing string 20 is reduced, a pressure differential between captured pressure in the chamber 72 and the reducing wellbore pressure causes the piston 70 to move, shearing the shear pins 69*a*, and permitting the sleeves 66 of the closure 60 to uncover the ports 65.

Figure 5:
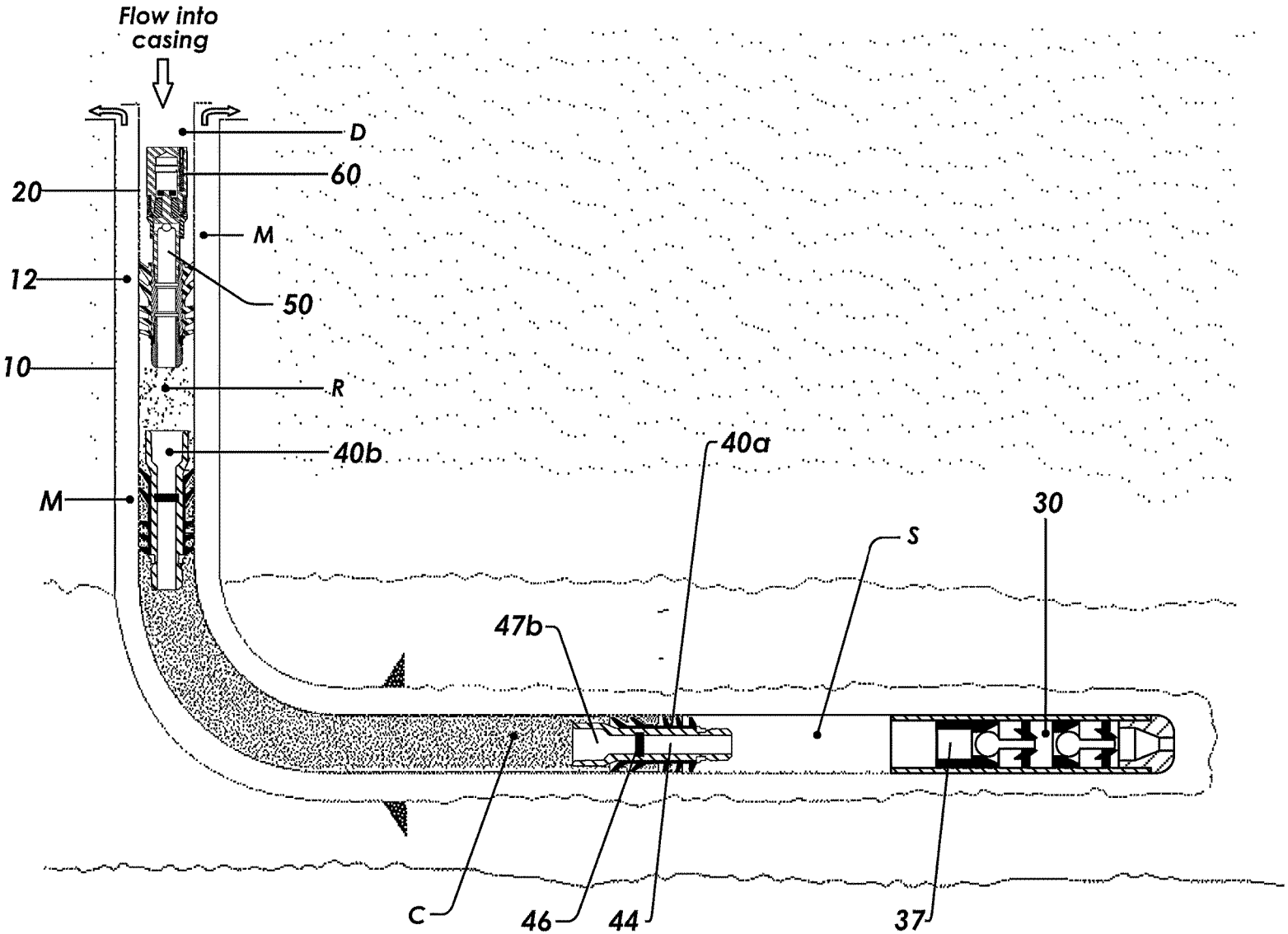
FIG. 5 illustrates components of the system during stage of another example cementing operation according to the present disclosure.

FIG. 5 illustrates another example of a cementing operation according to the present disclosure. This assembly includes a bottom wiper plug 40*a*, an intermediate wiper plug 40*b*, and a top wiper plug 50. The bottom wiper plug 40*a* is deployed and separates an advancing spacer fluid (S) from following cement slurry (C). This plug 40*a* lands on the landing 37 of the collar 30, and pressure from the pumped cement slurry (C) opens the barrier 46 so the cement slurry (C) can pass through the plug's passage 44, through the collar 30, and into the annulus 12 of the borehole 10.

The intermediate wiper plug 40*b* is deployed and separates the advancing cement slurry (C) from a following retarding fluid (R). This plug 40*b* lands on the seat 47*b* of the bottom wiper plug 40*a*, and pressure from the pumped fluid opens the barrier 46 so the retarding fluid (R) can pass through the plug's passages 44, through the landing collar 30, and into the toe. Finally, the top wiper plug 50 is deployed and separates the advancing retarding fluid (R) from the following displacement fluid (D). This plug 50 lands on the seat 47*b* of the intermediate wiper plug 40*b*. Pressure from the pumped fluid is used for the pressure integrity testing until the closure 60 on the top plug 50 is opened so fluid circulation is re-established.

Again, the fluid circulation re-established through the landing collar 30 can allow for other operations to be performed without requiring tubing-conveyed perforating to be performed in the tubing string 20 to open of flow path. For example, wireline perforating guns and composite plugs can be pumped down to begin stimulation operations. If desired, a first stimulation operation can be performed through the landing collar 30.

As disclosed herein, the assembly according to the present disclosure can be used with a tubing string 20, such as casing in a liner system, to test the pressure integrity of the installation. The assembly can also be used to produce flow to create a wet shoe track, where unset or no cement is left in a tubing section between a landing collar 30 and the toe shoe after the primary cementation is complete. The assembly can be used for a number of applications, such as plug-and-perf applications, cementing liners and long strings, horizontal and vertical wells, etc.

The top wiper plug 50 engaged with the bottom wiper plug 40 or other landing prevents fluid (at least partially) from passing further downhole. This creates a pressure seal that allows operators to perform a casing integrity test up to a desired test pressure level, such as 10,000 psi. Accordingly, fluid pressure can be pumped behind the seated wiper plug 50 to test the tubing 20 in the borehole 10 before the cement has been set up in the annulus. This tubing pressure test can have a number of advantages in testing the installation. For example, the high-pressure casing integrity test can be completed for increased efficiency at the time of the wiper plug 50 bumping against the landing or other seat, before obtaining a wet shoe condition. This process reduces costs and increases efficiency for the operator because this process can eliminate the need to re-enter the wellbore at a later time to deploy a ball or a plug downhole to perform a pressure test.

Figure 6A:
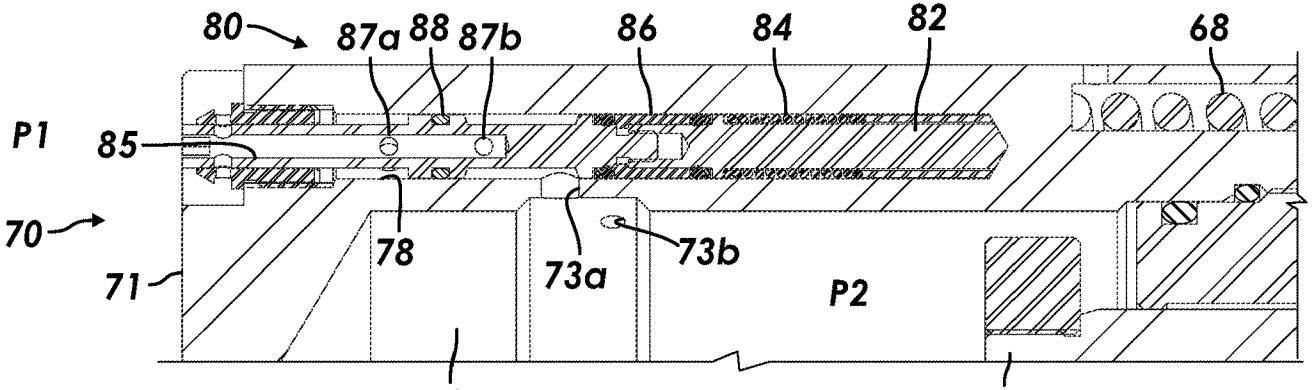
FIGS. 6A-6B illustrate a control valve of the second type of wiper plug in an opened condition.
Figure 6B:
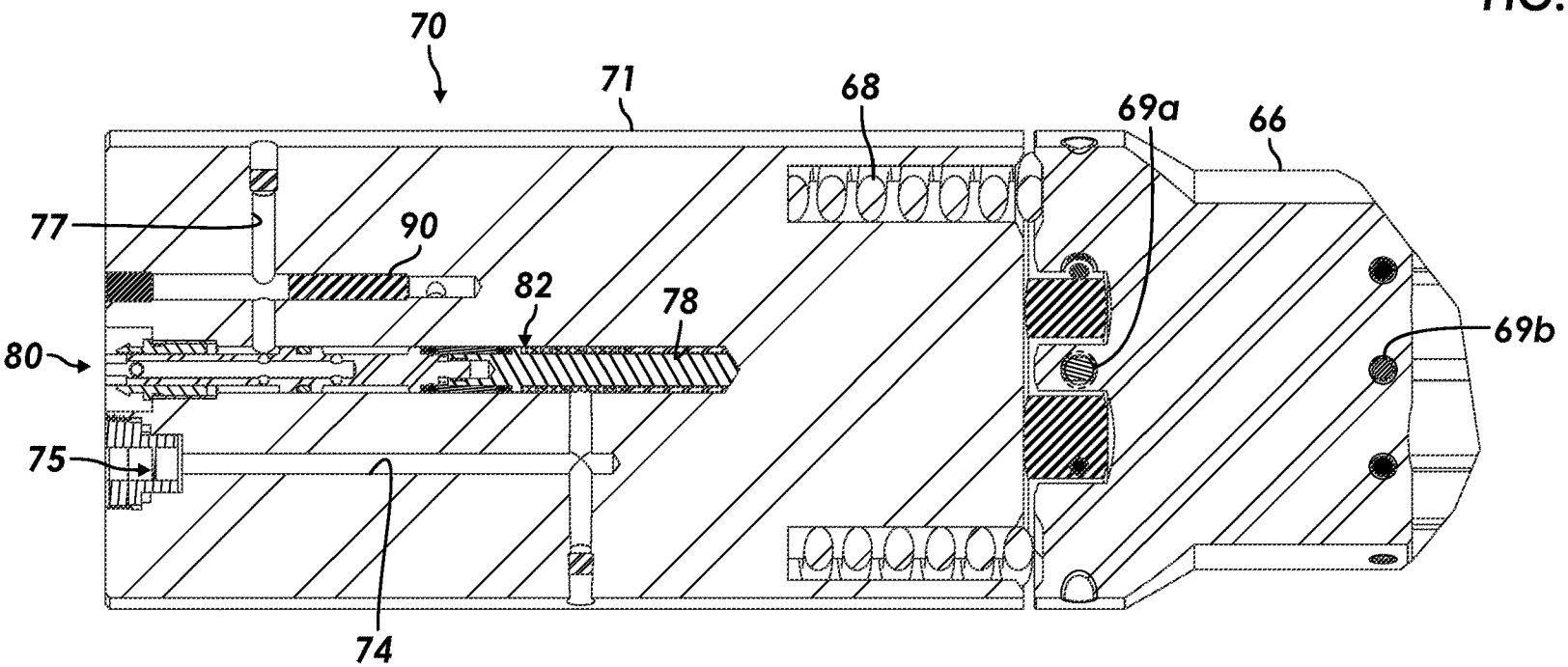
Figure 7A:
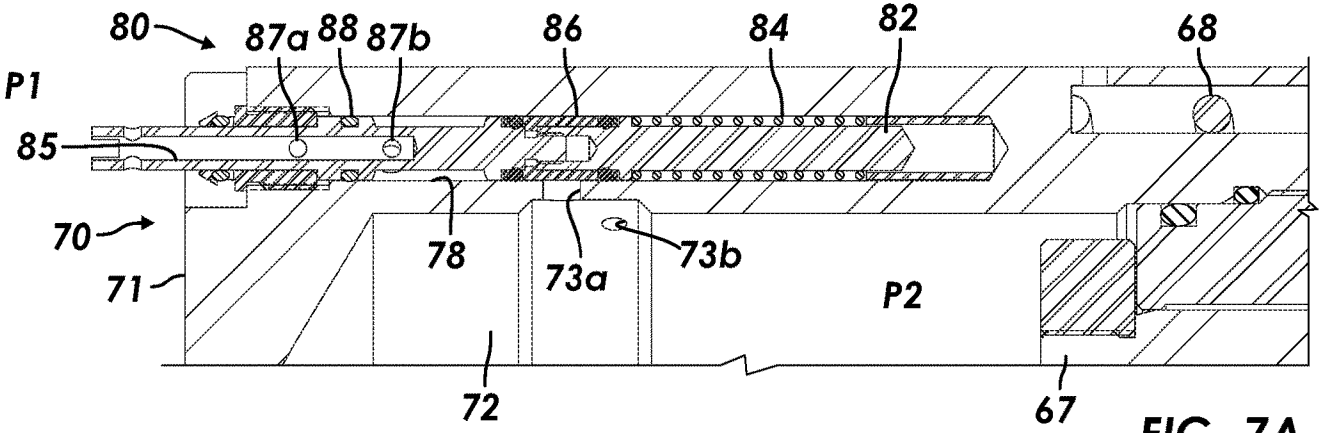
FIGS. 7A-7B illustrate the control valve of the second type wiper plug in a closed condition.
Figure 7B:
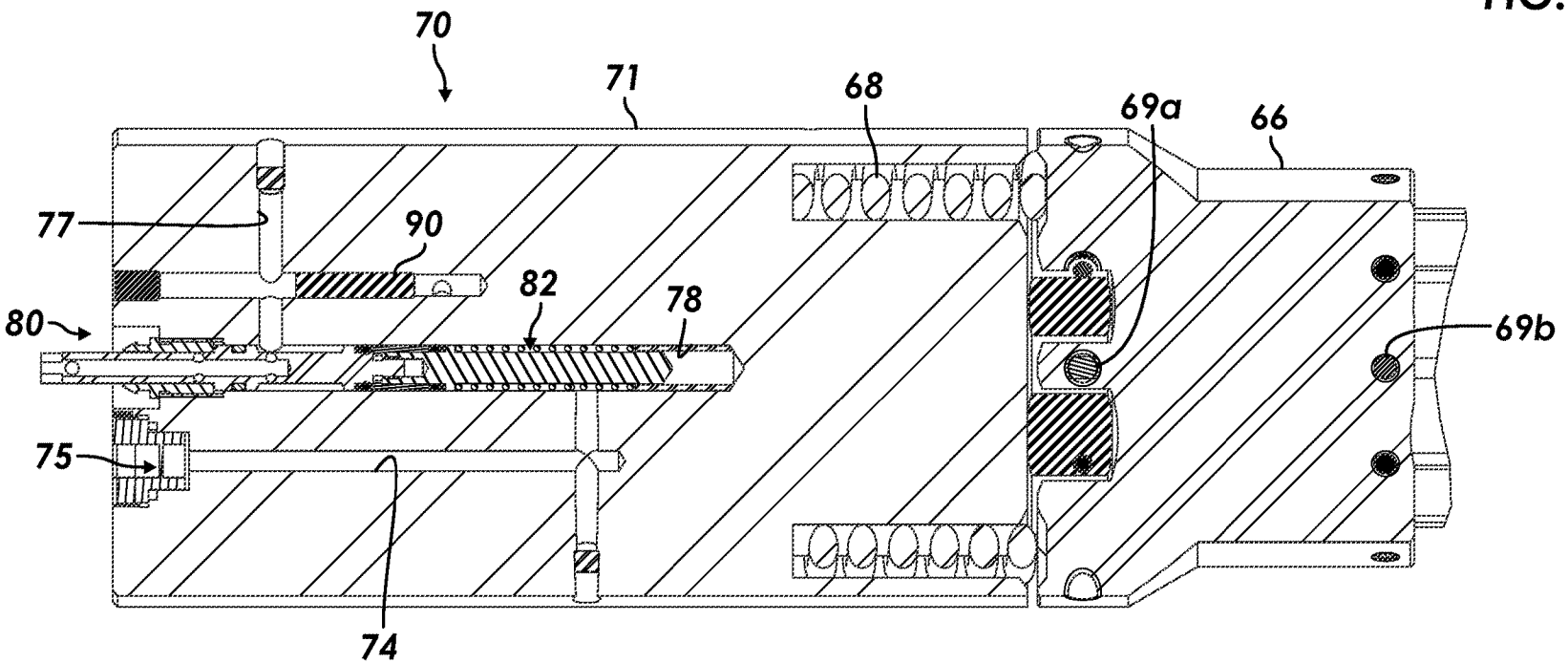

FIGS. 6A-6B illustrate portions of the closure 60, the piston 70, and the control valve 80 for the top wiper plug (50) in a first condition, and FIGS. 7A-7B illustrate portions of the closure 60, the piston 70, and the control valve 70 for the top wiper plug (50) in a second condition.

In one configuration, the control valve 80 can use a check valve that can constantly feed fluid pressure over a predetermined level from the tubing string 20 into the piston chamber 72. A thermal relief valve may be needed for the piston chamber 72 because downhole temperatures may equalize between the time of bumping the plug 50 and the time of performing the casing integrity test.

In another configuration, the control valve 80 can use a normally open valve to control pressure communication between the piston chamber 72 and the tubing string 20. The control valve 80 can close once a predetermined pressure level is reached so that pressure is captured in the chamber 72. In yet another configuration, the valve control 80 can use two valves. One control valve 80 is a set valve that remains open and is set to close at a predetermined pressure level. Thereafter, the set control valve 80 remains closed when the pressure level is reduced. The other valve can be used as a fill valve 90 that allows pressure to enter the chamber 72 of the piston 70, but can prevent pressure from leaving the chamber 72. This fill valve 90 can be a poppet valve, a check valve, a breaking valve, or the like. Preferably, the fill valve 90 requires only a small displacement to open and close.

Looking at the control valve 80 in FIGS. 6A-6B, the piston 70 is shown with the piston housing 71 mounted on the stem 67 of the wiper plug (50). The piston housing 71 includes the piston chamber 72, which can hold a pressure P2 therein. Outside the piston chamber 72, the piston housing 71 is exposed to the pressure P1 in the tubing in which the wiper plug (50) is deployed. The control valve 80 includes a valve pin 82 disposed in a valve passage 78 in the housing 71. The valve pin 82 includes a pack-off seal 86 and a differential seal 88. An inner end of the valve pin 82 is biased by a spring 84, which tends to push the valve pin 82 in the passage 78 outward from the piston housing 71. An outer end of the valve pin 82 is exposed to the tubing pressure P1 beyond the housing 71. This outer end of the pin 82 defines an internal passage 85 with two side ports 87*a-b* communicating outside the pin 82 on both sides of the differential seal 88.

As shown in FIG. 6B, a first passage 74 in the piston housing 71 connects a rupture disc 75 on the outside of the housing 70 with the valve passage 78 on the inner side of the pin's pack-off seal 86 toward the inner end of the valve pin 82. A second passage 76 in the housing 71 connects with the valve passage 78 on the outer side of the pack-off seal 86. The first passage 74 initially holds a low (atmospheric) pressure so the valve pin 82, under the influence of the hydrostatic pressure P1 in the tubing, initially tends to move into the opened condition as shown in FIGS. 6A-6B against the bias of the spring 84. With the valve pin 82 in this opened condition, a port 73 in the piston chamber 72 can communicate with the valve passage 78 on the outer side of the pack-off seal 86. Ultimately, the piston chamber 72 can communicate outside the piston housing 71 through the internal passage 85 and two side ports 87*a-b* of the pin 82 so pressure can be communicated into the pressure chamber 72.

As can be seen, the piston chamber 72 can have two ports 73*a-b* that allow pressure P1 from above the plug (50) to communicate into the piston chamber 72. One of the ports 73*a* communicates through the control valve 80, and the other port 73*b* can be unrestricted or may have an inlet valve (90). The control valve 80 is also installed through the passage 78 in which the two ports 73*a-b* are connected to. The control valve's pin 82 has a spring 86 in the fully compressed state located on the inner end which is held in that position by a small atmospheric volume of the passage 74. The atmospheric passage 74 is connected to a rupture disk 75. When the rupture disc 75 is ruptured, pressure/fluid communication is permitted from the tubing above the plug (50) to enter at the inner end of the valve pin 82.

As noted, the piston housing 71 is connected to the sleeve 66 of the closure 60 using the shear screws 69*a*. The sleeve 66 is used to cover the communication ports 65 to below the plug (50). Being held in the compressed state, the spring 68 attempts to move the piston housing 71 from the sleeve 66. The sleeve 66 is also pinned to the body extension 62 using pins 69*b*, which prevents the sleeve 66 (and the piston 70 affixed by the shear pins 69*a*) from moving upwards.

Because the one port 73*a* into the chamber 72 is unrestricted, the chamber pressure P2 is equalized to the hydrostatic pressure P1 while the wiper plug (50) is being pumped downhole, during the bump, and while the cement is curing. During the casing test, the applied pressure in the tubing increases to a threshold to where the rupture disk 75 is activated.

Pressure is still communicated to the piston chamber 72 of the piston housing 71 through the valve pin 82. Upon bleed down from the casing test, the valve pin 82 can travel upwards due to the compressed spring 86, and the unrestricted port 73*a* is covered by the pack-off seal 86. The valve pin 82 captures the chamber pressure P2 in the chamber 72, which is now higher than the hydrostatic pressure P1 in the tubing. This pressure differential from the increase in pressure P2 within the piston chamber 72 creates a piston force on the stem 67 within the piston chamber 72. In particular, the differential pressure increase between P1 and P2 causes a net force down on the stem 67, which can be considered a fixed point. A net force acting on the piston 70 attempts to pull the piston 70 off of the stem 67. The force transmits between the stem 67 and the piston 70 through the sleeve 66 via the shear screws 68*a* and the guide pins 69*b*. The piston force is exerted on the shear screws 69*a* connected between the piston housing 71 and the sleeve 66. The piston force is also exerted on the guide pins 69*b*, which initially prevents movement of the piston 70.

Upon shear of the shear pins 69*a*, the piston chamber 72 travels upwards due to the pressure differential until it shoulders against the end of the stem 67. Meanwhile, the external sleeve 66 travels downwards due to the compressed spring 68 between the piston housing 71 and the sleeve 66. Once the sleeve 66 travels downwards, the communication ports 65 for the plug (50) are exposed so fluid can communicate from the tubing above the plug (50), through the plug passage 64, 54, and out the head (57*a*) of the plug (50) seated in the bottom wiper plug (40).

The piston 70 does not need to shift down upon shearing so that pressure is not increased in the volumes (54, 64, 44)

of the plugs (50, 40). The piston 70 does not rely on only a spring force to overcome the hydrostatic pressure acting down on the plug (50).

Figure 8:
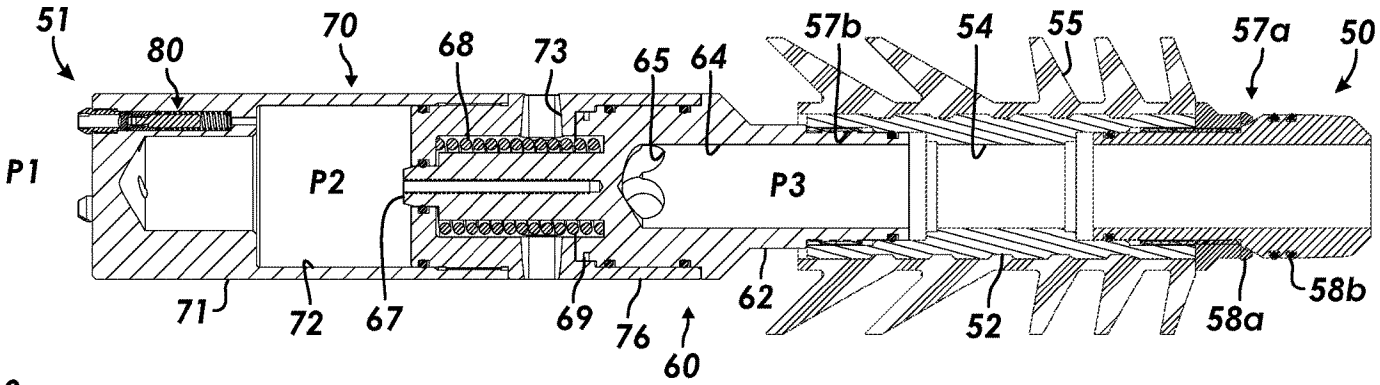
FIG. 8 illustrates a cross-sectional view of a third type of wiper plug for the assembly of the present disclosure.

FIG. 8 illustrates a cross-sectional view of a third type of wiper plug 50 for the assembly according to the present disclosure. Many of the features of this wiper plug 50 can be similar to that discussed above so similar reference numerals are used and the details are not repeated here.

This wiper plug 50 includes a closure 60, a piston 70, and a control valve 80. The closure 60 includes an extension 62 and a biasing element 68. The extension 62 is affixed in a seating area 57*b* of the body 52. The extension 62 has a passage 64 in communication with the body's passage 54. Side ports 65 are defined in the extension 62 to communicate with the extension's passage 64, and a stem 67 extends from the end of the extension 60.

The piston 70 includes a piston housing 71, a piston chamber 72, side ports 73, and a sleeve 76. In the closed condition, the sleeve 76 is disposed on the outside of the extension 62, and a biasing member or spring 68 on the extension 62 urges against the piston 70. When the sleeve 76 is held by shear pins 69, the sleeve 76 seals with O-rings on the extension 62 and closes off the side ports 65 to prevent fluid communication.

Figure 9B:
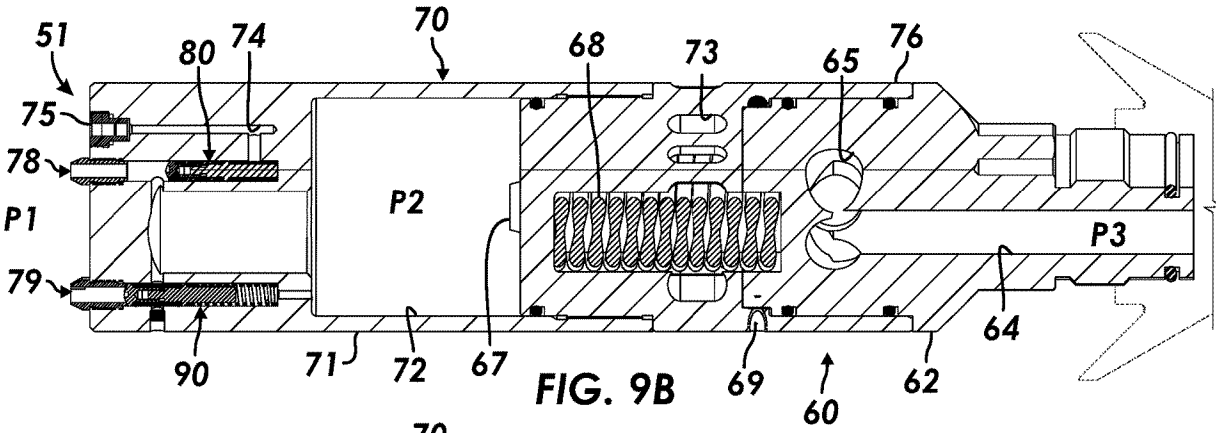
FIG. 9B illustrates a cross-sectional of the valve control for the third type of wiper plug in first condition.
Figure 9C:
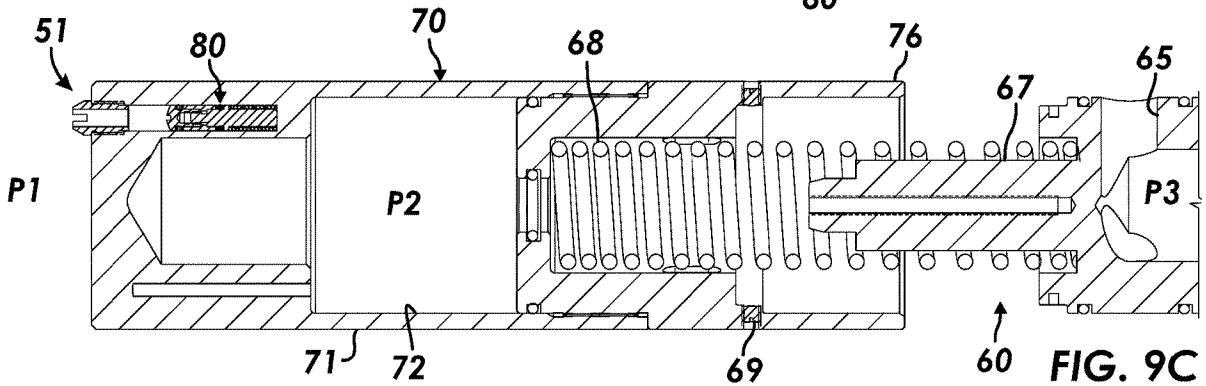
FIG. 9C illustrates a cross-sectional of the valve control for the third type of wiper plug in a second condition.
Figure 9A:
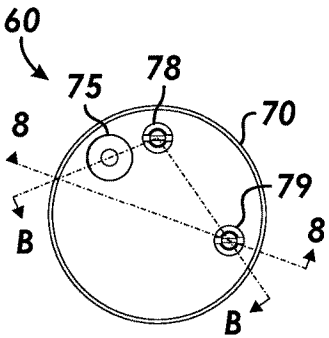
FIG. 9A illustrates an end view of the of a control valve for the third type of wiper plug.

FIG. 9A illustrates an end view of the of the piston 70 for the wiper plug 50 of FIG. 8. The end of the piston 70 includes rupture disk 75, a control port 78, and an inlet port 79 to communicate inside the piston 70. The cross-section of FIG. 8 is indicated by line 8-8. Meanwhile, the cross-section of FIG. 9B is indicated by line B-B. Showing the piston 70 and the control valve 80 in a first condition in FIG. 9B, this cross-section of the control valve 80 reveals details of the rupture disk 75 for the atmospheric passage 74 on the piston 70. Additionally, the control valve 80 is disposed in the control port 78 of the piston 70 between the piston chamber 72 and atmospheric passage 74. An inlet valve 90 is disposed in the inlet port 79 relative to the piston chamber 72. Meanwhile, FIG. 9C illustrates a cross-section of the piston 70 and the control valve 80 for the wiper plug (50) in a second condition.

Looking at FIGS. 9A-9C, the piston housing 71 is movably disposed on the stem 67 of the extension 62. Pressure within the piston chamber 72 is controlled by the control valve 80 and the low pressure (atmospheric) volume in the passage 74 on the piston 70. A rupture disc or other temporary barrier 75 closes the volume of the passage 74, and the control valve 80 remains opened. The inlet valve 90 in the inlet port 79 can permit high-pressure to enter the pressure chamber 72.

Tubing pressure P1 above the piston 70 acts against the piston 70, and tubing pressure P1 can pass through side ports 73 to act between the piston 70 and the extension 62. At the same time, pressure P2 in the piston chamber 72 acts against the stem 67 and urges the piston 70 away from the extension 62. When the pressure in the piston chamber 72 increases to a predetermined level discussed below, the shear pins 69 holding the sleeve 76 break, and the spring 68 urges the sleeve 76 open relative to the ports 65, as shown in FIG. 9C. The sleeve 76 in this opened condition allows fluid communication through the passages 64, 54 of the wiper plug 50.

During operations and similar to what is noted above, the bottom plug (40) is landed on the landing collar (30). The top plug 50 is pumped downhole, and the head (57*a*) of the top plug 50 is bumped and landed into the bottom plug (40) at the end of the cementing operation. In this initial condition upon bump, the tubing pressure P1 and the chamber pressure P2 of the pressure chamber 72 are equal. The internal pressure P3 in the volumes (64, 54) of the plug (50) is equal to the hydrostatic tubing pressure P1.

Upon bleed down after the bump, the tubing pressure P1 and the chamber pressure P2 are both equal to the casing hydrostatic pressure. The plug's internal pressure P3 is unchanged. The control valve 80 remains open so pressure in the tubing can communicate with the pressure chamber 72. The atmospheric passage 74 holds the control valve open in the run-in position with the spring 86 compressed.

During the casing test, tubing pressure is increased. A rupture pressure for the rupture disc 75 is reached prior to reaching the ultimate test pressure. The low (atmospheric) pressure in the passage 74 is lost, and the control valve 80 is released and shifts to the closed position trapping accumulated chamber pressure P2 within the chamber 72. Once the rupture disk 75 ruptures, for instance, the pressure above and below the control valve 80 is equal, and the compressed spring (84) pushes the control valve 80 into the closed position to trap the accumulated chamber pressure P2.

Upon bleed down after the casing test, the tubing pressure P1 decreases back down to the casing hydrostatic pressure. The control valve 80 is closed, and the captured chamber pressure P2 in the chamber 72 remains high. The internal pressure P3 of the plug (50) is still unchanged.

The increase in differential pressures between P2 and P1 creates a piston effect, which loads unto the shear screws 69. Once the screws 69 are sheared (at about 5000 to 6000 psi), the piston 70 travels upwards past the shear plane, allowing the spring 68 to uncompress and move the sleeve 76 as shown in FIG. 9C, exposing the flow ports 65 and equalizing the tubing pressure P1 and the internal plug pressure P3.

Details of the control valve 80 and the inlet valve 90 of the dual valve arrangement are described with reference to FIGS. 10A-10C, which illustrate schematic sectional view of the piston 70 during stages of operation.

Figure 10A:
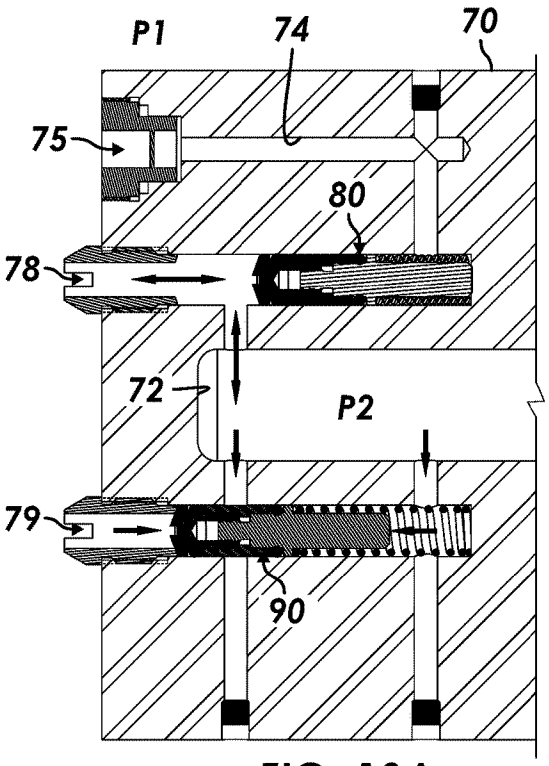
FIGS. 10A-10C illustrate schematic sectional views of the valve control during stages of operation.

FIG. 10A shows the valves 80, 90 in an initial condition during pump down of the plug (50). The internal piston chamber 72 is in full communication with hydrostatic pressure P1 outside of the control valve because the low (atmospheric) pressure in the passage 74 holds the control valve 80 in the open position. Hydrostatic pressure P1 can pass through the control passage 78 to the piston chamber 72.

When the plug 50 bumps and lands downhole, the internal piston chamber 72 remains in full communication with hydrostatic pressure P1, and the atmospheric pressure in the passage 74 still holds the control valve 80 in the open position. The only load applied on the shear screws 69 comes from the compression spring 68. The load from the compression spring 68 may be only a fraction (e.g., 10%) of the total shear force.

Figure 10B:
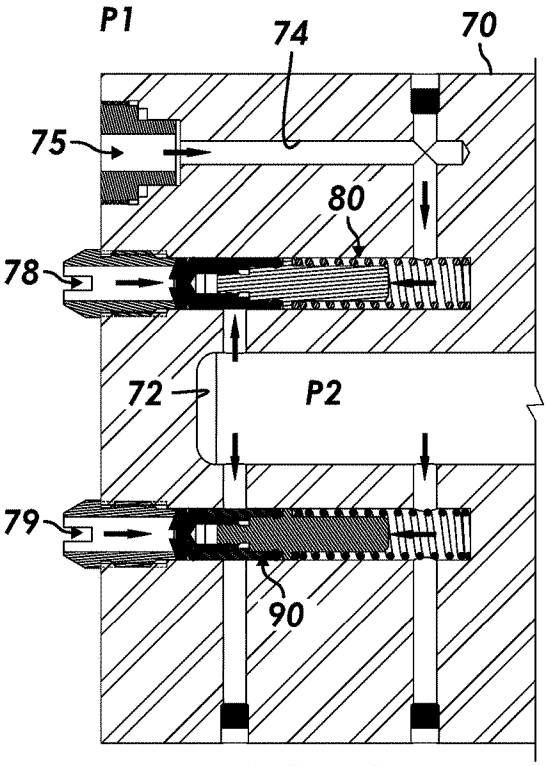

During the casing pressure test as shown in FIG. 10B, casing test pressure is increased and fills the piston chamber 72. Eventually, the casing test pressure exceeds the rupture pressure of the rupture disk 75. The atmospheric passage 74 is thereby opened, which allows the control valve 80 to close. Although shown closed here, the inlet valve 90 can open and can still check fluid pressure into the chamber 72 while performing the casing test.

Figure 10C:
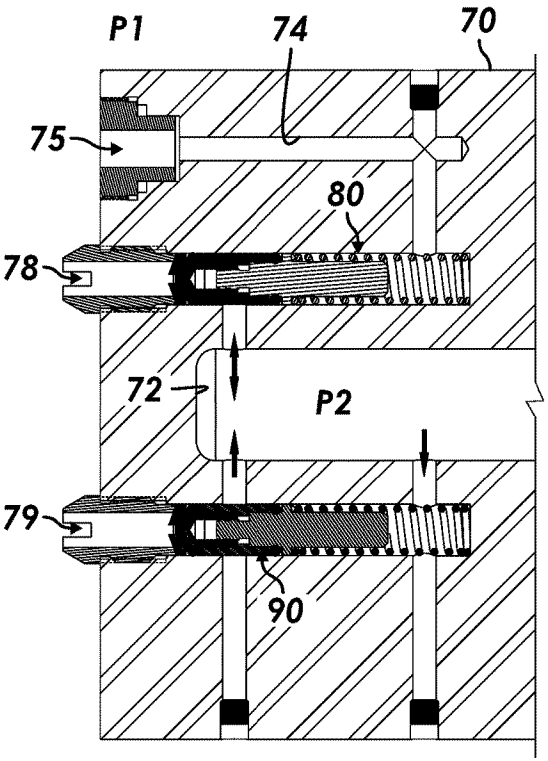

FIG. 10C shows the bleed down of pressure after the casing pressure test. The bleed down of the tubing pressure P1 increases the differential between the captured pressure P2 in the piston chamber 72 relative to the tubing pressure P1. The differential pressure acts on a piston area of the closure 60 (namely on the stem 67), and the differential pressure applies force on the shear screws 69.

Eventually, the force shears the shear screws 69, and the O-ring engaged with the stem 67 unseats, and the pressure P2 in the piston chamber 72 equalizes to the bottom-hole pressure P1. The spring 68 continues to uncompress and to push the piston 70, which removes the sleeve 76 from the extension's ports 65 and allows for fluid injection to pass through the plug (50).

Figure 11A:
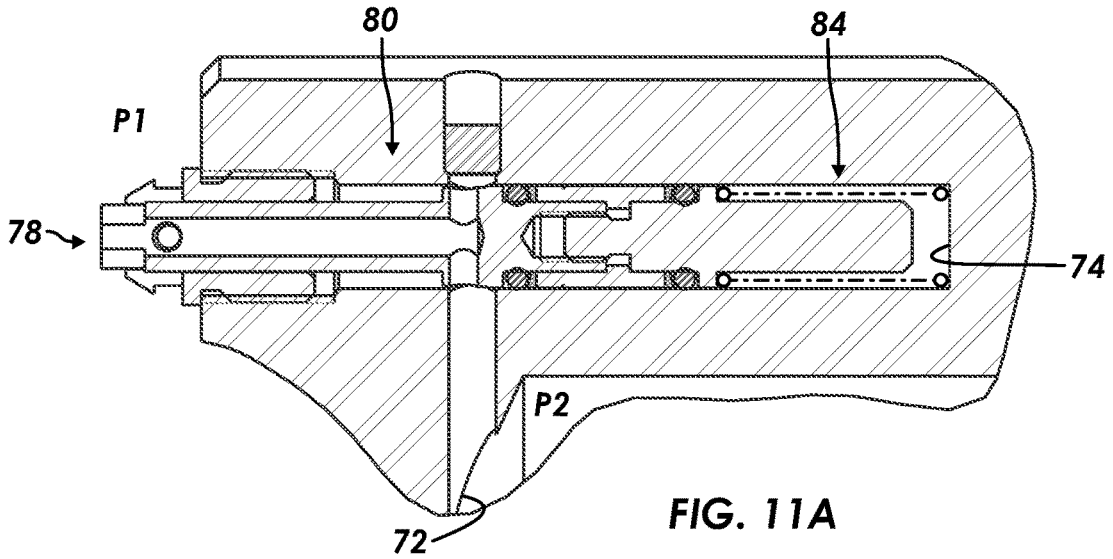
FIGS. 11A-11C illustrate an alternative form of control valve for the present disclosure in different conditions.
Figure 11B:
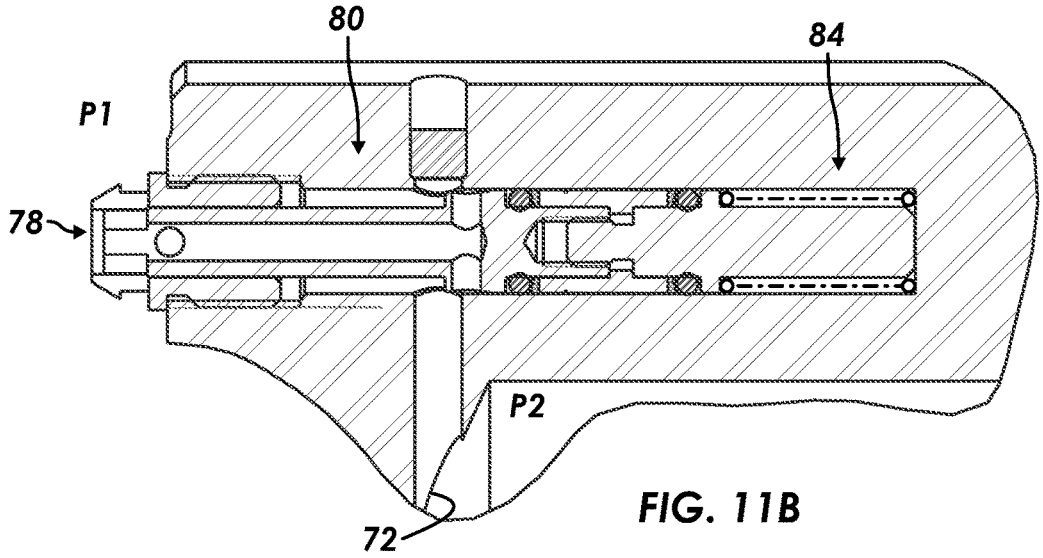
Figure 11C:
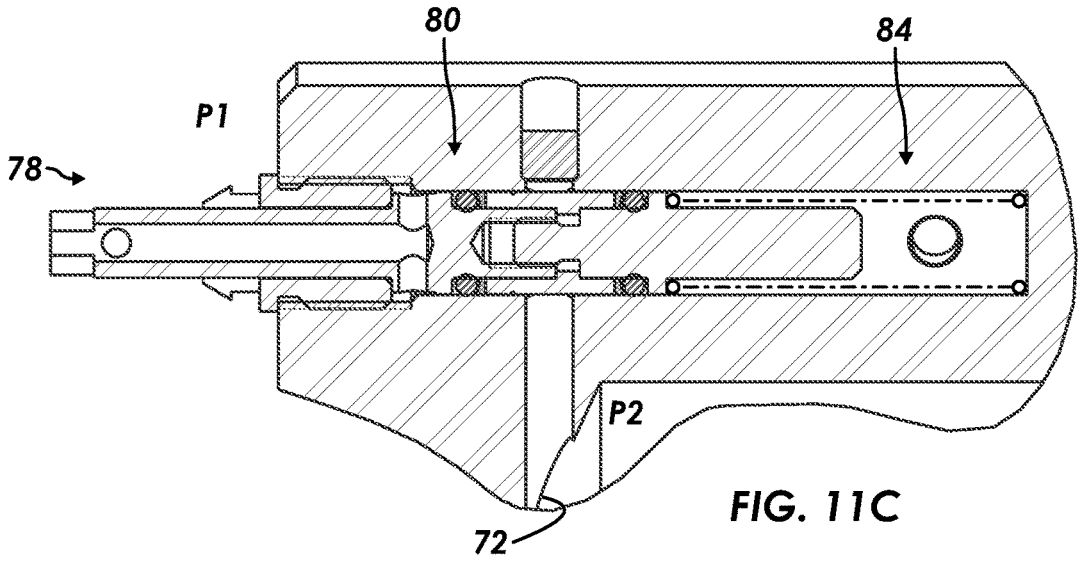

FIGS. 11A-11C illustrate an alternative form of a control valve 80 for the present disclosure in different conditions. As shown in FIG. 11A, the control valve 80 is pinned with a shear device (not shown) in a partially open position because the spring rate of the valve's spring 84 may be higher than the force of the atmospheric chamber 74 when the control valve 80 is on surface. As the plug (50) is pumped downhole, the additional hydrostatic pressure shears the control valve 80 free, allowing it to fully open and fully compress the spring 84, as shown in FIG. 11B. Finally, upon bleed down, the control valve 80 can close to capture pressure in the chamber 72, as shown in FIG. 11C.

The assembly of the present disclosure can be used with the systems and methods disclosed in U.S. Pat. No. 10,954,740 to WEATHERFORD NETHERLANDS, B.V., which is incorporated herein by reference in its entirety. For example, the top wiper plug 50 of the present disclosure can be used with upper and lower bottom plugs (40) and can be deployed in a tubing string having a pre-load collar and a landing collar. The lower bottom plug (40) can have a catch mechanism to engage in the preload collar, and the upper bottom plug (40) can include a pressure seal, such as a rupture disc for use in the cementing operations.

Figure 12:
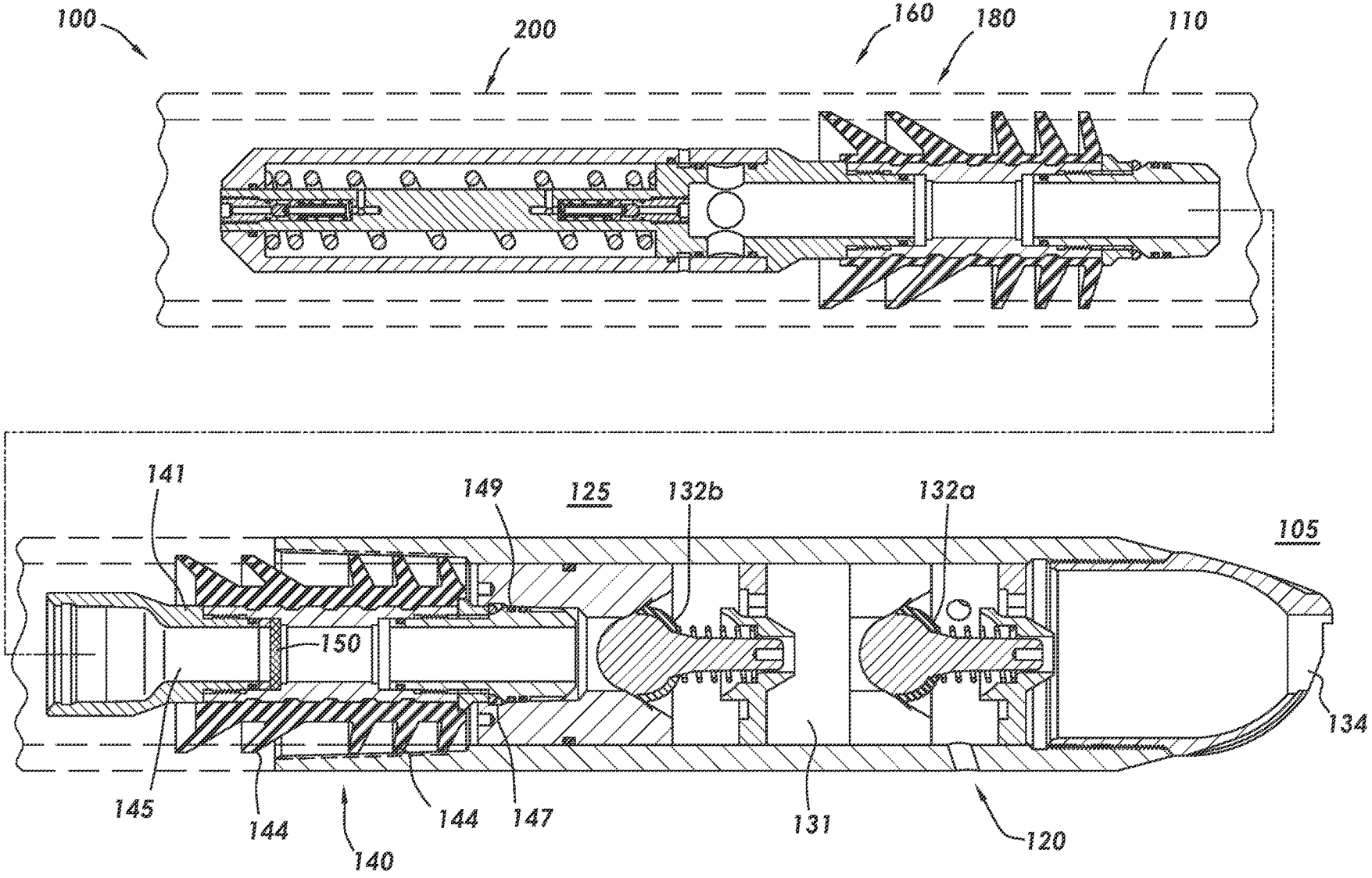
FIG. 12 is a side cross-sectional view of a plug and valve system for cementing or other downhole operations in a subterranean wellbore according to embodiments of the present disclosure.

FIG. 12 illustrates an embodiment of a system 100 for a cementing operation. A tubular, such as casing 110, has been lowered into a wellbore 105 and includes a collar assembly disposed at a lower end of the casing 110. The collar assembly may be a float assembly 120. The float assembly 120 includes a bore 131 and may include one or more valves 132A, 132B for controlling fluid flow through the bore 131. In one embodiment, the valves 132A, 132B are one-way valves configured to allow fluid to flow through the bore 131 and out of the casing 110, but prevent fluid re-entering the casing 110 through the bore 131. The fluid may flow out of the casing 110 through a port 134 at the bottom of the casing 110. In another embodiment, the collar assembly may be a landing collar, which may include a bore without a valve, such as the collar assembly shown in FIG. 18.

As shown, a first plug assembly 140 and a second plug assembly 160 are used to separate the fluids used in the cementing operation. For example, a first fluid may be disposed below the first plug assembly 140, a second fluid disposed between the first and second plug assemblies 140, 160, and a third fluid disposed above the second plug assembly 160. The fluids may be drilling fluids, cement, spacer fluids, displacement fluids and the like.

In some embodiments, a first plug assembly separates the cement from a spacer fluid behind the cement while a second plug assembly separates the spacer fluid from a displacement fluid behind the spacer fluid. Additional plug assemblies may be used to separate additional fluids. For example, a third plug assembly may be used to separate the cement from a fluid in front of the cement. The terms "above" and "below, and "behind" and "in front," are used herein without respect to whether the wellbore is vertical or horizontal. For example, a fluid, tool or the like, said to be "above" or "behind" another is relatively closer to the wellhead, having entered the wellbore later, whether along a horizontal or vertical portion of the wellbore. As persons of skill in the art will understand, the disclosures herein are applicable in horizontal and vertical wells.

In one embodiment, the first plug assembly 140 includes a body 141 having an internal passage or bore 145 extending through the body 141. A rupture disk 150 is positioned within the bore 145 and, when intact, blocks fluid flow through the bore 145. The rupture disk 150 is configured to break at a predetermined pressure.

The first plug assembly 140 may include one or more fins 144 circumferentially positioned on the exterior surface of the body 141 for sealingly contacting the wall of the casing 110. The fins 144 act as a barrier to prevent comingling of fluids from above and below the first plug assembly 140. The fins 144 may clean the wall of the casing 110 as the plug 140 descends in the casing 110.

A latching or retaining mechanism 147 may be provided to attach to the float assembly 120. Suitable retaining mechanisms include a latch or a snap ring, for example. One or more seals or sealing members 149, such as a O-rings, may be disposed between the first plug assembly 140 and the float assembly 120. It is contemplated the first plug assembly 140 may be any suitable cement plug known to a person of ordinary skill in the art.

When the first plug assembly 140 reaches the float assembly 120, fluid pressure may be increased within the bore sufficient to break the rupture disk 150. After the disk 150 breaks, the first plug bore 145 is open, allowing the fluid above the first plug assembly to flow through the first plug assembly 140, through the float assembly 120, and out to an annulus 125.

Figure 13:
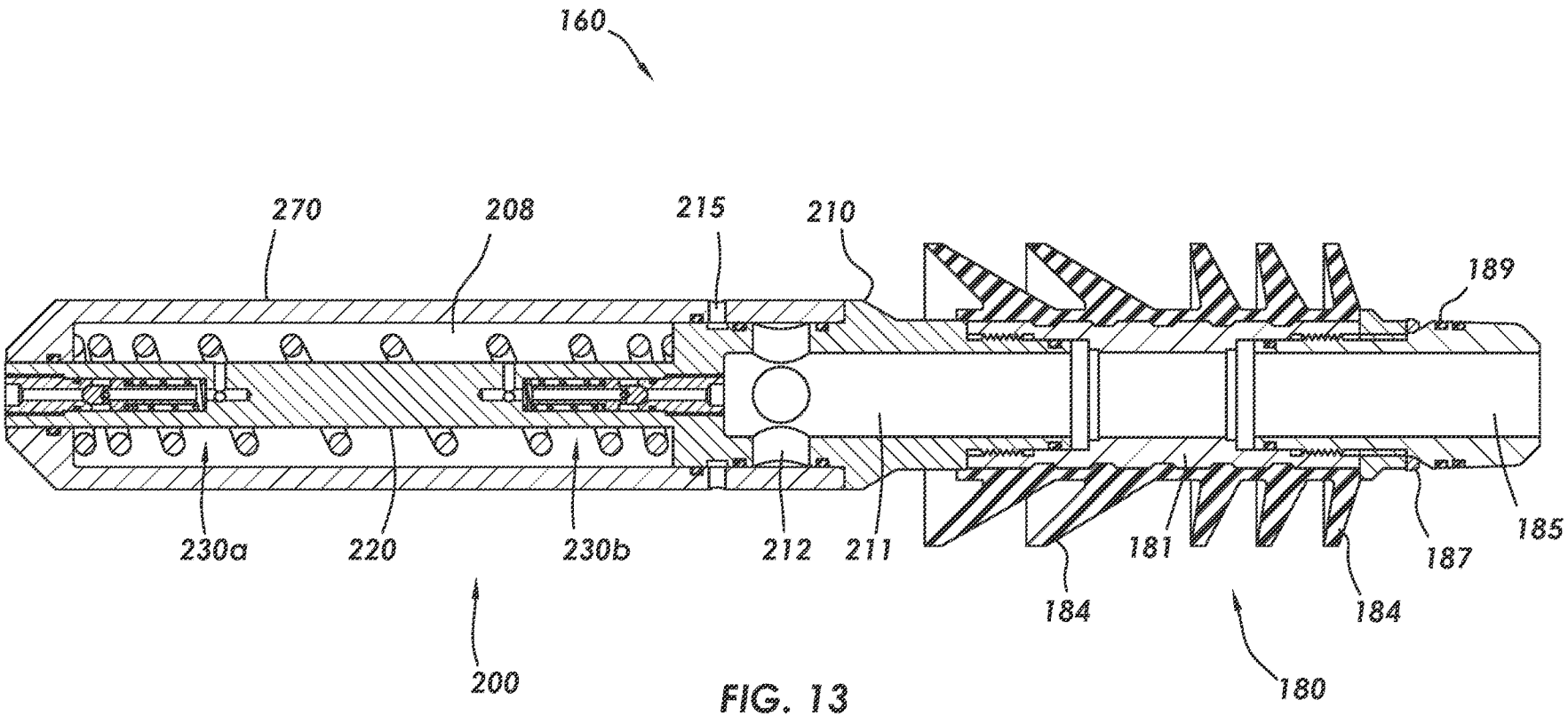
FIG. 13 is a side cross-sectional view of an exemplary plug assembly according to aspects of the disclosure.
Figure 14A:
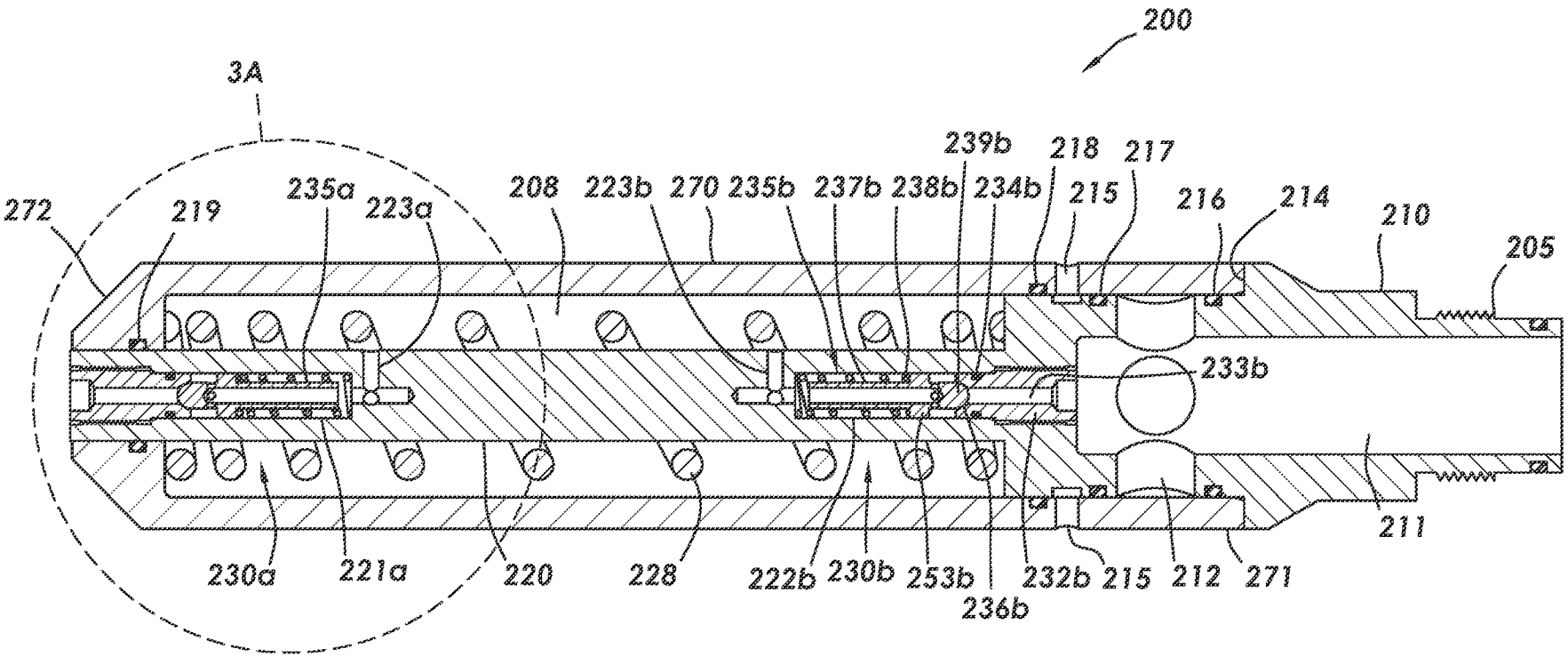
FIG. 14A is a side cross-sectional view of the valve unit of the plug assembly of FIG. 13.
Figure 14B:
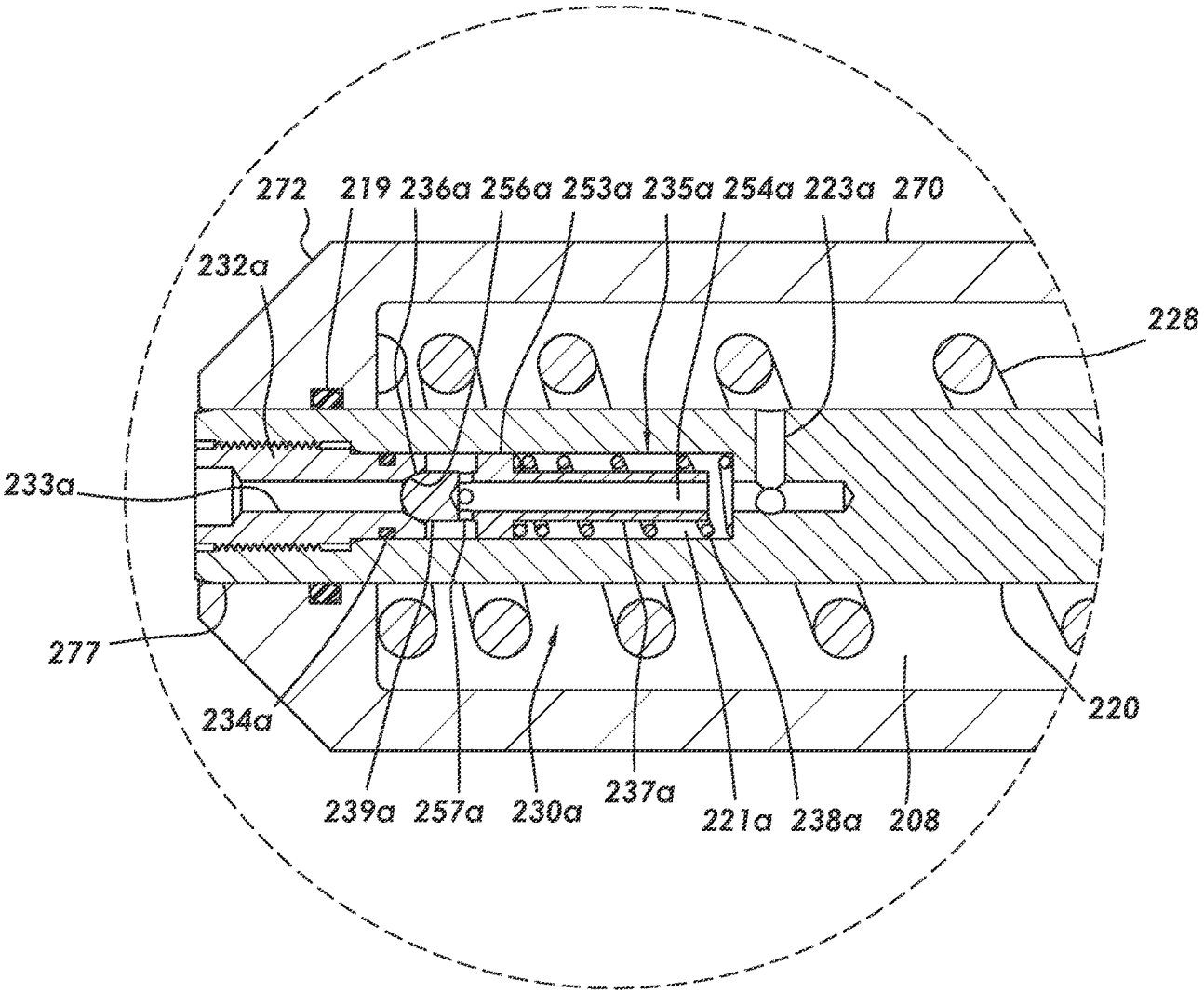
FIG. 14B is an enlarged partial view of the valve unit of FIG. 14A.

The second plug assembly 160 travels behind the first plug assembly 140. The second plug assembly 160 may be released from the surface or a subsurface location. In one embodiment, the second plug assembly 160 includes a valve unit 200 coupled to a plug unit 180, as shown in FIGS. 12 and 13. FIG. 14A shows the valve unit 200, and FIG. 14B is an enlarged partial view of the valve unit 200.

The plug unit 180 includes a body 181 having a bore 185 extending through the body 181. The plug unit 180 may include one or more fins 184 circumferentially positioned on the exterior surface of the body 181 for sealingly contacting the wall of the casing 110. The fins 184 act as a barrier to prevent comingling of fluids from above and below the plug unit 180. The fins 184 may clean the wall of the casing 110 as the plug unit 180 descends in the casing 110.

A retaining mechanism 187 may be provided for attachment to the first plug assembly 140. Suitable retaining mechanisms include a latch or a snap ring, for example. One or more sealing members 189, such as O-rings, may be disposed between the plug unit 180 and the first plug assembly 140.

In one embodiment, the valve unit 200 is attached to the upper end of the plug unit 180. Referring to FIGS. 13, 14A, and 14B, the valve unit 200 includes a valve body or body extension 210 coupled to an external sleeve 270. The valve body 210 has a connection end 205 for connection with the plug unit 250, and a stem extension 220. The valve body 210 includes an axial bore 211 open to the connection end 205. One or more ports 212 are formed through the wall of the valve body 210 and are in fluid communication with the bore 211. The valve body 210 has an outer diameter that is larger than an outer diameter of the stem extension 220. In some embodiments, the valve unit 200 is integrated with the plug unit 180.

The external sleeve 270 has a lower sleeve portion 271 disposed around a portion of the valve body 210. The lower sleeve portion 271 has an inner diameter sized to accommodate the valve body 210. The end of the lower sleeve portion 271 may optionally engage a shoulder 214 formed on the valve body 210.

The external sleeve 270 also has an upper portion 272 disposed around a portion of the stem extension 220. The upper portion 272 forms a piston having a piston housing enclosing a chamber 208 with the stem extension 220. Meanwhile, a releasable fixture 215 releasably holds the external sleeve in a closed condition on the valve body 210. For example, one or more shearable members 215 may be used to attach the external sleeve 270 to the valve body 210. Suitable shearable members 215 include shear pins, shear screws, and snap rings. A plurality of sealing members 216, 217, 218 are disposed between the external sleeve 270 and the valve body 210 to limit fluid communication therebetween.

In this embodiment, a sealing member 216, 217 is disposed on each side of the port 212. Sealing members 217, 218 are located on each side of the one or more shearable members 215. An exemplary sealing member is an O-ring. The upper portion 272 includes an opening 277 sized to accommodate the stem extension 220. A sealing member 219 is disposed in the opening 277 and between the external sleeve 270 and the stem extension 220 to limit fluid communication therebetween.

The chamber 208 is formed between the external sleeve 270 and the valve body 210. In this example, the chamber 208 is an annular chamber defined between the external sleeve 270 and the stem extension 220 of the valve body 210. The annular chamber 208 fluidly communicates with the upper stem bore 221*a* and the lower stem bore 222*b* via the upper port 223*a* and the lower port 223*b*, respectively. In some embodiments, the upper stem bore 221*a* is connected to the lower stem bore 222*b*, and the upper and lower stem bores can fluidly communicate with the annular chamber 208 using a single port, although additional ports may be used.

A biasing member 228, such as a spring, is disposed in the annular chamber 208. In this embodiment, the lower end of the biasing member 228 engages valve body 210, and the upper end of the biasing member 228 engages the external sleeve 270. The biasing member 228 is arranged to urge the external sleeve 270 axially away from the valve body 210.

The valve unit 200 may include a control valve or valve sub-assembly. As shown here, the valve unit 200 may include two opposing control valves or valve sub-assemblies 230*a* and 230*b*. The valve sub-assemblies function as one-way valves. Both valve sub-assemblies are seen in FIG. 14A, positioned opposing one another in the valve unit 200. A detail of the upper valve sub-assembly 230*a* is seen in FIG. 14B.

An upper valve sub-assembly 230*a* includes a seat sleeve 232*a* configured to engage a seal piston 235*a*. The seat sleeve 232*a* is disposed in the upper portion of the upper stem bore 221*a* and may be threadedly connected to the upper stem bore 221*a* or attached using other suitable mechanisms such as a lock ring. A bore 233*a* extends through the seat sleeve 232*a* and provides fluid communication between the lower portion of the upper stem bore 221*a* and the bore of the casing 110 above the upper valve sub-assembly 230*a* when the seal piston 235*a* is in an open position.

A sealing member 234*a*, such as an O-ring, is disposed between the seat sleeve 232*a* and the stem extension 220*a*. The lower end of the seat sleeve 232*a* includes a sealing surface 236*a* configured to sealingly engage a sealing surface 256*a* of the seal piston 235*a*. In some embodiments, the sealing surfaces 236*a*, 256*a* are arcuate in shape. In some embodiments, the upper valve sub-assembly 230*a* is disposed in the external sleeve 270 instead of the stem extension 220.

The seal piston 235*a* includes a head portion 239*a* and a tubular body 237*a*. The head portion 239*a* includes the sealing surface 256*a* for engaging the sealing surface 236*a* of the seat sleeve 232*a*. The tubular body 237*a* has an outer diameter smaller than the inner diameter of the upper stem bore 221*a*. The tubular body 237*a* includes an enlarged outer diameter portion 253*a* engaged with stem extension 220*a*.

A biasing member 238*a*, such as a spring, is disposed in the annular area between the stem extension 220*a* and the tubular body 237*a*. In this embodiment, the lower end of the biasing member 238*a* engages the stem extension 220*a*, and the upper end of the biasing member 238*a* engages the enlarged portion 253*a*. The biasing member 238*a* is configured to urge the seal piston 235*a* upward toward the seat sleeve 232*a*.

The tubular body 237*a* includes a bore 254*a* extending from the lower end of the tubular body 237*a* to the head portion 239*a*. The bore 254*a* provides fluid communication axially through the enlarged portion 253*a*. One or more ports 257*a* provide fluid communication between the upper end of the bore 254*a* and the annular area above the upper end of the enlarged portion 253*a*.

The lower valve sub-assembly 230*b* is similarly arranged as the upper valve sub-assembly 230*a*. Referring to FIG. 14A, the seat sleeve 232*b* is disposed in the lower portion of the lower stem bore 222*b* and may be threadedly connected to the lower stem bore 222*b*. The bore 233*b* of the seat sleeve 232*b* provides fluid communication between the upper portion of the lower stem bore 222*b* and the bore 211 of the valve body 210, which in turn communicates with the casing below the lower valve sub-assembly 230*b*.

The seal piston 235*b* is configured to seal against fluid communication from below, for example, from the bore 211 of the valve body 210. In this respect, the biasing member 238*b*, such as a spring, is configured to urge the seal piston 235*b* downward toward the seat sleeve 232*b*. In comparison, the seal piston 235*a* of the upper valve sub-assembly 230*a* is biased in the opposite direction. The bore of the tubular body 237*b* extends from the lower port 223*b* to the head portion 239*b* of the lower piston 235*b* and is selectively in communication with the seat sleeve bore 233*b* and bore 211 when the piston 235*b* is in an open position.

When pressure is communicated through the upper valve sub-assembly 230*a* into the chamber 208, the increase in pressure also serves to bias the lower valve sub-assembly 230*b* into the closed position. The opposite is true where pressure is communicated into the chamber 208 through the lower valve sub-assembly 230*b*. In some embodiments, the upper valve sub-assembly 230*a* and the lower valve sub-assembly 230*b* are configured to open at the same pressure differentials. Alternatively, the valve sub-assemblies 230*a-b* can be constructed to open at different pressure differentials. For example, the spring 238*a* of the upper valve sub-assembly 230*a* may have a different biasing force than the spring 238*b* of the lower valve sub-assembly 230*b*.

Referring back to FIG. 12, as the second plug assembly 160 travels downward in the casing 110 toward the first plug assembly 140, the pressure in the annular chamber 208 equalizes with the pressure above or below the second plug assembly 160 via the valve sub-assemblies 230*a* and 230*b*. If the pressure below, or in "front" of, the second plug assembly 160 is higher than the pressure in the annular chamber 208 (plus the force of the bias spring), then pressure in the annular chamber 208 is increased to equalize with the pressure below the second plug assembly 160. For example, a higher pressure below the second plug assembly 160 will be communicated through the bore 211 of the lower valve sub-assembly 230*b*. The higher pressure causes the seal piston 235*b* to unseat from the seal sleeve 232*b*, thereby opening the lower valve sub-assembly 230*b* for fluid communication.

The fluid pressure then communicates through ports 257*b*, bore 254*b*, and lower port 223*b* to the annular chamber 208. The pressure in the annular chamber 208 increases until the pressure differential is insufficient to maintain the seal piston 235*b* in the open position. In one example, the seal piston 235*b* closes when the pressure below is less than the pressure in the annular chamber 208 and the biasing force of the spring 238*b*.

If the pressure above, or "behind," the second plug assembly 160 is higher than the pressure in the annular chamber 208, then pressure in the annular chamber 208 is increased to equalize the pressure above the second plug assembly 160. For example, the higher pressure above the second plug assembly 160 may be communicated through the bore 233*a* of the seat sleeve 232*a*. The higher pressure causes the seal piston 235*a* to unseat from the seal sleeve 232*a*, thereby opening the upper valve sub-assembly 230*a* for fluid communication. The fluid pressure then communicates through ports 257*a*, bore 254*a*, and upper port 223*a* to annular chamber 208.

The pressure in the annular chamber 208 increases until the pressure differential is insufficient to maintain the seal piston 235*a* in the open position. In one example, the seal piston 235*a* closes when the pressure above drops to the pressure in the annular chamber 208 and the biasing force of the spring 238*a*. In this respect, the second plug assembly 160 is configured to increase its internal pressure to that of the external pressure, either above or below. The pressure is retained in the chamber 208 and may be used for a later downhole operation, such as releasing the external sleeve 270, as discussed below.

Figure 15:
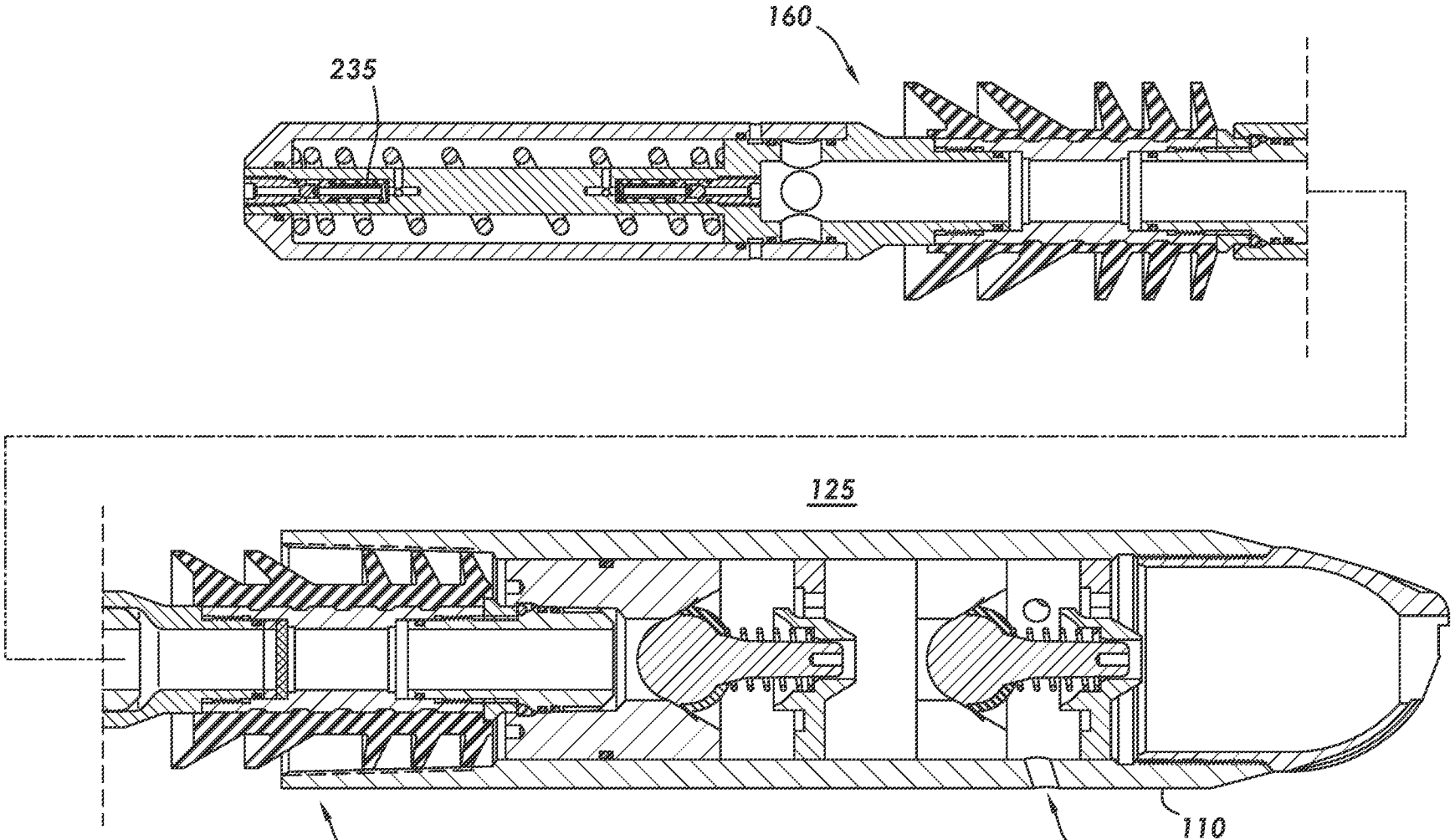
FIG. 15 is a side cross-sectional view of the plug assembly of FIG. 13 landed on a first plug assembly and float shoe, according to aspects of the disclosure.

The second plug assembly 160 will travel down the casing 110 until it lands on the first plug assembly 140, as shown in FIG. 15. In this position, the second plug assembly 160 has pushed the fluid between the first and second plug assemblies 140, 160 out of the casing 110 and into the annulus 125. Upon landing, the pressure above the second plug assembly 160, also referred to as the bump pressure, may be the same as the pressure in the annular chamber 208.

In some instances, a casing integrity test may be performed after cementing to test the integrity of the casing 110. The test begins by increasing the pressure in the casing 110 above the second plug assembly 160 until it reaches a predetermined test pressure. Because the test pressure is higher than the bump pressure, the pressure in the annular chamber 208 will increase to the test pressure.

At the end of the test, test pressure is bled-off from above. As the pressure above decreases, a pressure differential is created between the higher pressure in the chamber 208 and the lower pressure above. The pressure differential increases until it creates a piston effect sufficient to break the shearable members 215 attaching the external sleeve 270 to the valve body 210. The shearable members 215 may be shearable only in one direction, such as here, where the sleeve 270 is supported from below at shoulder 214.

Figure 16:
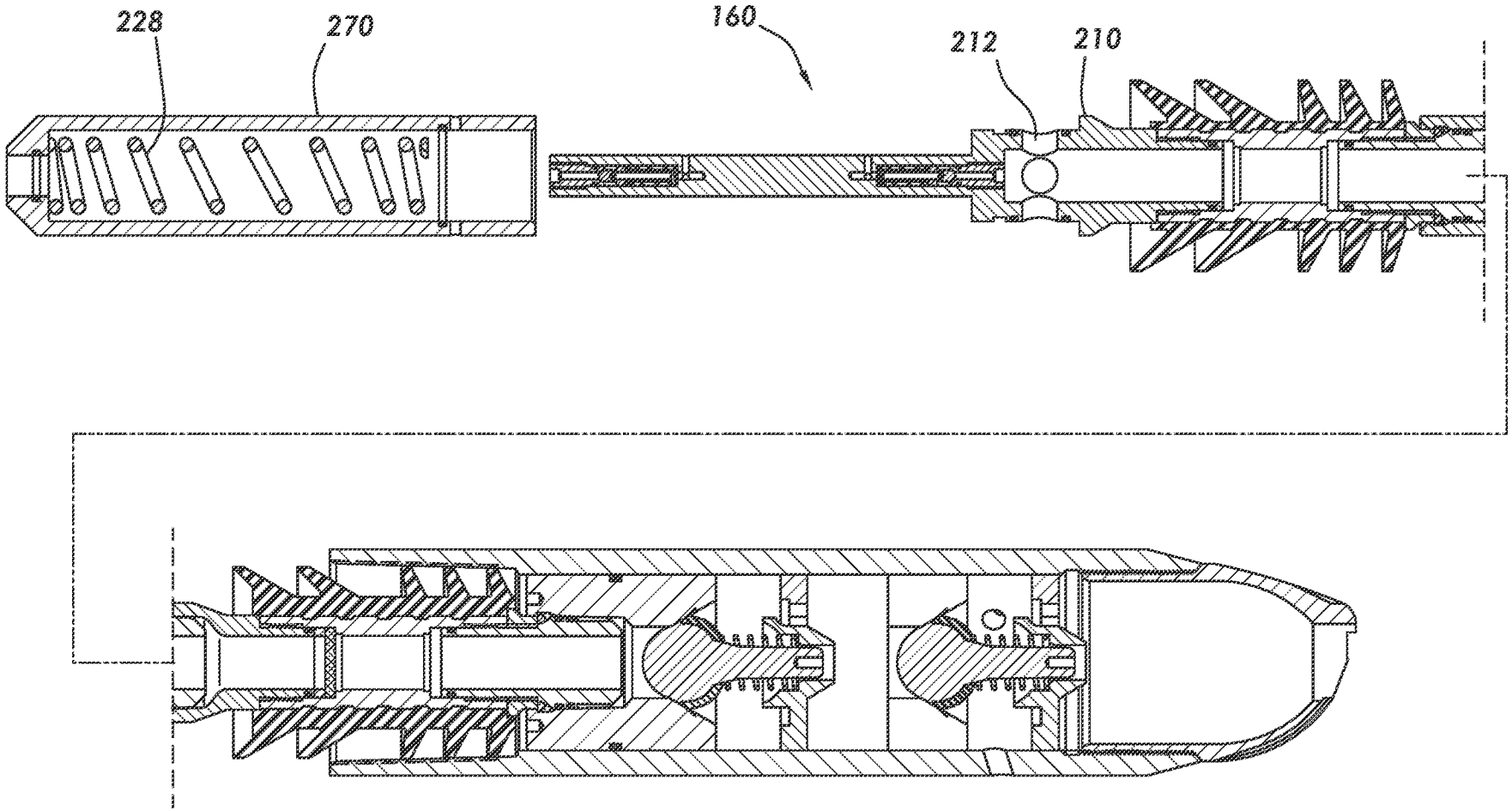
FIG. 16 is a side cross-sectional view of the system of FIG. 12 after removal of an external sleeve of the plug assembly of FIG. 13.

The external sleeve 270 is released from the valve body 210 to an open position, as shown in FIG. 16, wherein the ports 212 are open. The spring 228 in the annular chamber 208 may facilitate detachment of the external sleeve 270 from the valve body 210. In the open position, the second plug assembly 160 allows continued operations requiring communication of fluid or pressure through the bottom of the casing, such as injection operations, for example.

Figure 17:
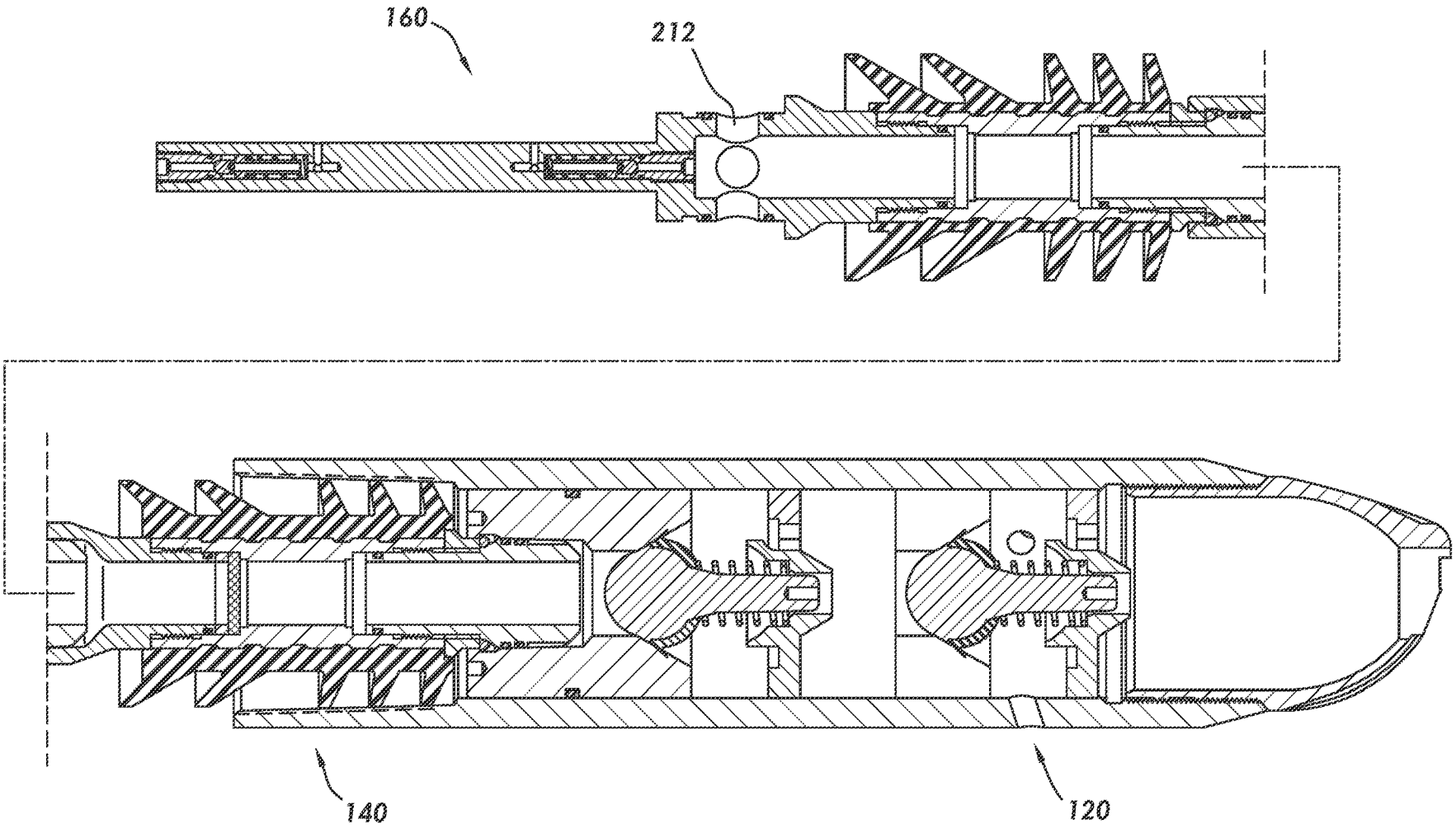
FIG. 17 is a side cross-sectional view of the system of FIG. 12 ready for an injection operation.

FIG. 17 shows the second plug assembly 160 after removal of the external sleeve 270 from the valve body. In some embodiments, the sleeve 270 can be moved to the open position but retained on the valve body 210. For example, see the embodiments herein in FIGS. 19-20. The sleeve 270 can move axially to open the radial ports 212. In some embodiments, the sleeve 270 moves axially to open the chamber 208, releasing the pressure therein.

In another embodiment, the second plug assembly 160 may be used without the first plug assembly 140. For example, the second plug assembly 160 may land directly into the float collar 120.

Figure 18:
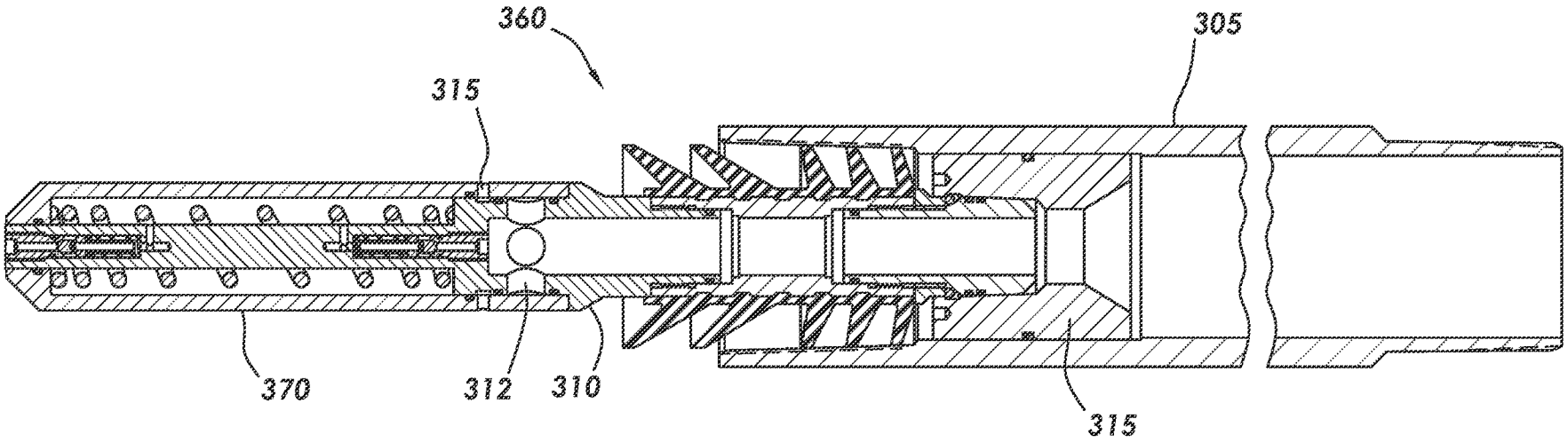
FIG. 18 is a side cross-sectional view of an exemplary valve unit and plug assembly according to aspects of the disclosure.

The second plug assembly 160 may be used for downhole operations other than cementing operations. As shown in FIG. 18, for example, a plug assembly 360 may be used as a floatation plug assembly. The plug assembly 360 is attached to a seat 315 in a casing 305. The lower end of the casing 305 may include a float collar (not shown), such as float collar 120 shown in FIG. 12.

A lower density fluid, such as air, is disposed between the float collar and the plug assembly 360. The lower density may reduce, e.g., "lighten," the weight of the casing 305 relative to the fluid in the wellbore, thereby facilitating movement of the casing 305 in the wellbore. After the casing 305 reaches the desired location, the plug assembly 360 may be opened for fluid communication. For example, pressure above the plug assembly 360 is increased until the pressure differential with the pressure in the annular chamber 308 is sufficient to shear the shearable members 315. Thereafter, the external sleeve 370 is released from the valve body 310, thereby opening the ports 312 for fluid communication.

Figure 19:
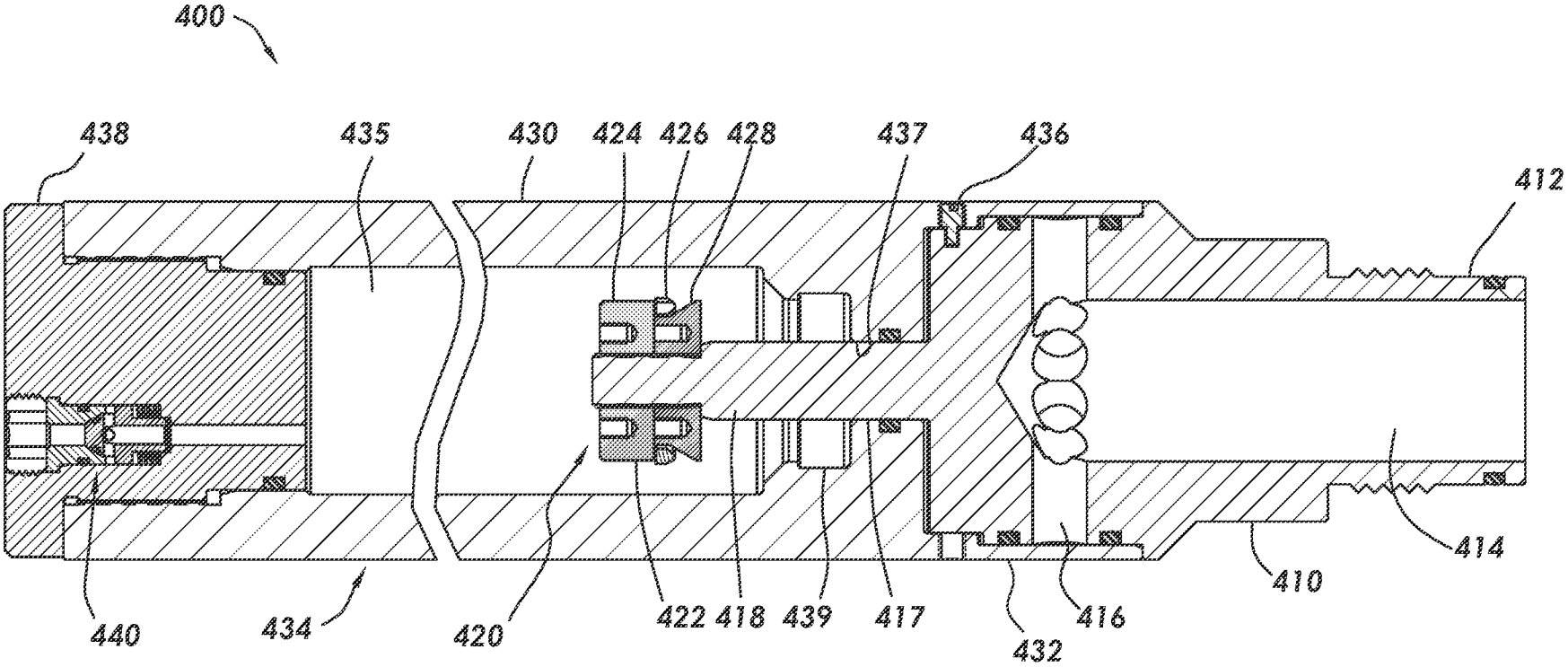
FIG. 19 is a side cross-sectional view of an exemplary valve unit in a run-in position according to aspects of the disclosure.
Figure 20:
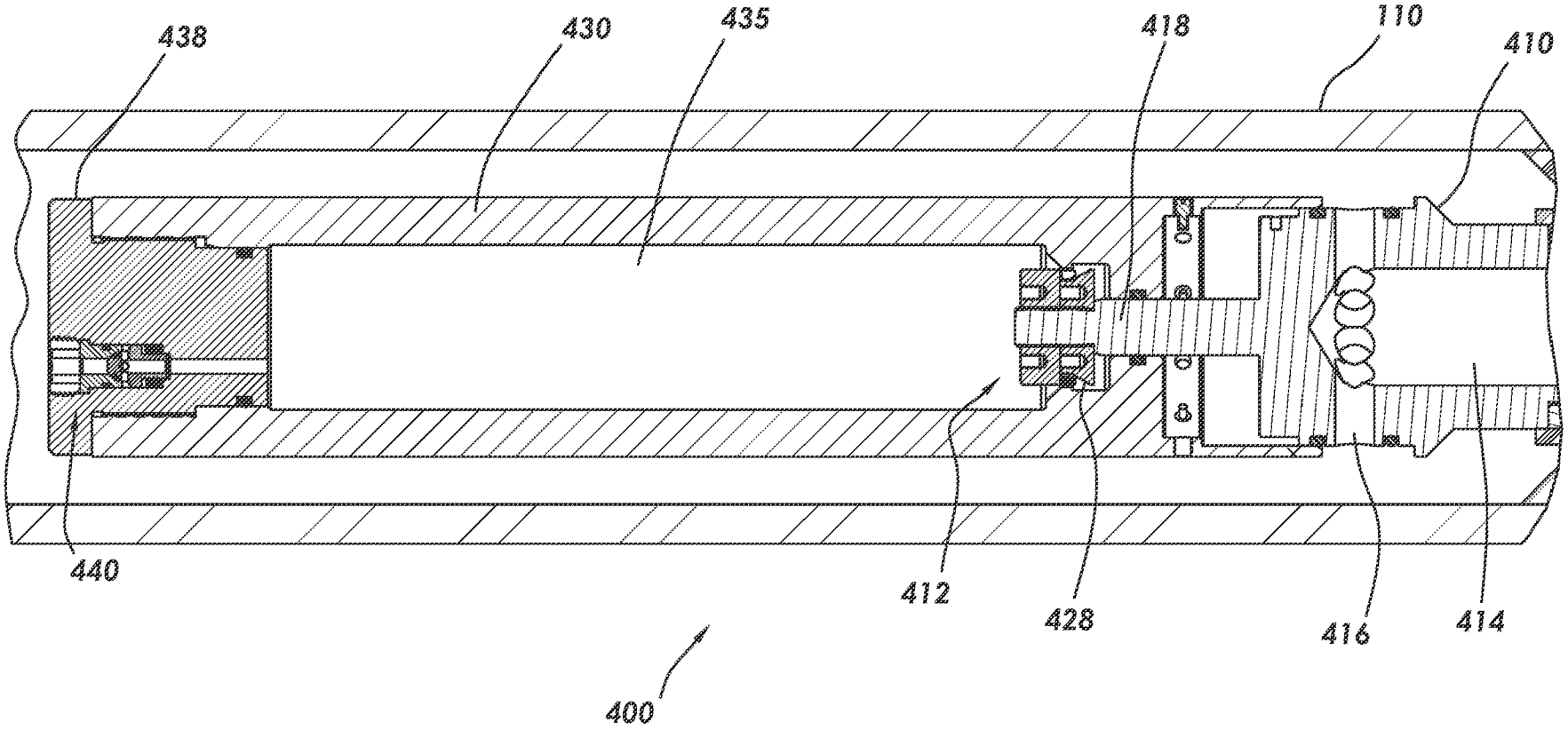
FIG. 20 is a side cross-sectional view of the valve unit of FIG. 19 in an open position according to aspects of the disclosure.

Another embodiment according to aspects of the disclosure is seen in FIGS. 19-20. FIG. 19 is a side, cross-sectional view of an exemplary valve unit 400 in a run-in position. FIG. 20 is a side cross-sectional view of the valve unit 400 of FIG. 19 in an open position. The valve unit 400 may be used as part of a plug assembly, as discussed previously. In other words, a valve body 410 of the valve unit 400 can be attached at its base 412 to a corresponding plug unit, such as that seen in FIG. 12 at plug unit 180.

The valve unit 400 has a sleeve 430 having a closure portion 432 and a piston portion 434 disposed on the valve body 410. The sleeve 430 is removably attached, such as at shearable members 436, to the valve body 410. A cap or upper body 438 is fixedly attached, such as at threaded connection, to the sleeve 430 to enclose the chamber 435.

The valve body 410 defines a longitudinal bore 414 which provides fluid communication below the valve unit 400, such as to a corresponding bore in a plug unit. The valve body 410 includes one or more radial ports 416 fluidly connected to the bore 414. The radial ports 416 are initially blocked by the closure portion 432 of the sleeve 430 when the unit 400 is in the run-in position, as seen in FIG. 19. The valve body 410 and sleeve 430 are selectively axially movable with respect to one another. The valve body 410 therefore connects to the sleeve 430 at an axially movable connection 417. An exemplary connection is shown in which the valve body 410 has a stem 418 extending through a cooperating stem bore 437 of the sleeve 430, wherein the stem 418 is slidable in the bore 437 when the sleeve 430 is released from the valve body 410.

In some embodiments, the sleeve 430 detaches from, and is no longer connected to, the valve body 410 upon axial movement of the sleeve 430. In the embodiment shown, the sleeve 430 moves axially with respect to the valve body 410 upon release of the sleeve 430 from the valve body 410 but is retained to the valve body 410 by a retention assembly 420, preventing the released sleeve 430 from floating free in the wellbore. To that end, an exemplary retention assembly 420 includes an upper end of the stem 418 connected to a retention device 422. The exemplary retention device 422 in the embodiment shown comprises a lock nut 424, a lock ring 426, and a washer 428, attached to the stem 418, for example, at a threaded connection.

The retention device 422 prevents the sleeve 430 from completely disconnecting from the lower body 404 and floating free when the sleeve 430 is selectively released from the valve body 410 at shearable members 436. The retention assembly 420 may further include a recess 439 defined in the sleeve 430 which cooperates with the lock ring 426 to attach the sleeve to the retention assembly upon movement of the sleeve 430 to the open position as seen in FIG. 20.

The sleeve 430 comprises a generally tubular wall defining an interior chamber 435. The interior chamber 435 is capable of holding against pressure and is plugged at its ends by the lower and upper bodies 410 and 438, respectively. In the embodiment shown, no biasing mechanism is provided to assist in moving the sleeve axially upon release of the sleeve upon shearing of the shearable members 436. In some embodiments, a biasing element (not shown), such as a coil spring or the like, can be used.

The upper body 438 includes a valve control or one-way valve sub-assembly 440 providing one-way fluid communication from above the valve unit 400 to the interior chamber 435. Upon a pressure differential across the upper body 438, a higher pressure above the chamber 435 results in pressuring up the chamber 435. In case of a pressure differential wherein the chamber pressure is higher, the pressure is not transmitted to above the unit 400 but is retained in the chamber 435. Exemplary one-way valve assemblies 440 are discussed herein with reference to valve sub-assemblies 230*a-b*. In some embodiments, a thermal relief valve (not shown) may be positioned to allow fluid communication from the chamber 435 to prevent damage to the valve unit 400 due to thermal expansion and pressure build-up in the chamber 435.

In use, the valve unit 400, attached to a plug unit as part of a plug assembly, is dropped or pumped downhole in a casing, pushing a wellbore fluid, such as cement, ahead of the assembly. If pressure above the plug exceeds pressure in the chamber 435, the one-way valve 440 communicates pressure into the chamber 435, where the pressure remains trapped. The plug assembly lands at the bottom of the casing on a previously lowered plug assembly or on a float shoe, such as seen in FIG. 15. Upon landing, the pressure in the casing above the valve unit 400 is equal to the pressure in the chamber 435. Upon bleed-down of the pressure above the valve unit 400, the pressure in the valve chamber 435 remains unchanged.

During casing integrity testing, the pressure in the casing above the valve unit 400 is increased. If casing pressure exceeds chamber pressure, the pressure in the chamber 435 is increased through fluid and pressure communication across the one-way valve sub-assembly 440. Upon pressure bleed-down after the integrity test, the chamber pressure remains high while the pressure above the valve unit 400 drops. The increase in pressure differential between the chamber 435 and casing above creates a piston effect, applying force against the shearable members 436 and shearing the members 436.

Upon shearing of the members 436, the sleeve 430 moves axially upwards with respect to the lower body 410 into the open position seen in FIG. 20, thereby opening ports 416 and equalizing pressure above the valve unit 400 and the bore 414 of the valve unit 400 through the ports 416. The sleeve 430 continues upward movement until it is stopped by the retention assembly 420. In the embodiment shown, the sleeve 430 is then retained in the open position by cooperation of the lock ring 426 and recess 439. The elevated pressure within the chamber 435 also works to move the sleeve 430 into the open and retained position.

Use of the exemplary plug assemblies herein results, upon release of the sleeve assembly, fluid communication from the casing above the unit, through any intervening plug assemblies and float assembly, to the wellbore below the float assembly, and thence into the formation. Thus, it is possible to pump fluids into the wellbore and formation, such as for injection operations. Further, the plug assembly, once in the open position, allows for pump-down of later-used tools, such as a perforation assembly. During pump-down of later tool assemblies, pressure build-up below the assembly is allowed to bleed-off through the one-way valves of the float assembly and into the wellbore or formation, for example.

The disclosed embodiments include a plug assembly for use in a wellbore, comprising: a plug unit having a longitudinal bore extending therethrough, the plug unit for sealingly engaging the wellbore; a valve unit having: a valve body with at least one radial port for fluid communication between the longitudinal bore of the plug unit and an exterior of the plug assembly above the plug unit; an external valve sleeve slidably attached to the valve body and axially movable between a closed position wherein fluid communication through the at least one radial port is prevented and an open position wherein fluid communication through the at least one radial port is permitted; a valve chamber for retaining fluid pressure; a first one-way valve sub-assembly providing pressure communication from the exterior of the plug assembly above the plug unit to the valve chamber, the external valve sleeve movable to the open position in response to a pressure differential between the valve chamber and the exterior of the plug assembly above the plug unit. Further embodiments supported by the disclosure include a plug assembly having any, some or all of the following elements, in any combination: a second one-way valve sub-assembly configured to provide pressure communication into the valve chamber from the longitudinal bore of the plug unit; wherein the first valve sub-assembly is positioned in a stem extension of the valve body; wherein the valve chamber comprises an annular valve chamber defined between the stem extension and the external valve sleeve; wherein the first valve sub-assembly is disposed in a bore defined in the stem extension; wherein the external valve sleeve is attached to the valve body by a shearable member, and wherein the external valve sleeve moves to the open position upon shearing of the shearable member; a biasing member biasing the external valve sleeve towards the open position; wherein in the open position the external valve sleeve is retained to the valve body by a retention assembly; wherein the retention assembly comprises a lock ring which cooperates with a recess defined in the external valve sleeve when the external valve sleeve moves to the open position; and/or wherein the external valve sleeve is detached from the valve body open movement to the open position.

The disclosure is provided in support of the methods claimed or which may be later claimed. Specifically, this support is provided to meet the technical, procedural, or substantive requirements of certain examining offices. It is expressly understood that the portions of the methods disclosed and claimed can be performed in any order, unless otherwise specified or necessary, that each portion of the method can be repeated, performed in orders other than those presented, that additional actions can be performed between the enumerated actions, and that, unless stated or claimed otherwise, actions can be omitted or moved. Those of skill in the art will recognize the various possible combinations and permutations of actions performable in the methods disclosed herein without an explicit listing of every possible such combination or permutation. It is explicitly disclosed and understood that the actions disclosed herein can be performed in various orders (xyz, xzy, yxz, yzx, etc.) without writing them all out.

The disclosure supports the following methods, such as a method of performing an operation in a tubular disposed in a wellbore, comprising: running a plug assembly down the tubular, the plug assembly pushing a fluid in the tubular ahead of the plug assembly; stopping the plug assembly in the tubular at a location downhole in the wellbore; increasing fluid pressure above the plug assembly; communicating the pressure increase through a one-way valve sub-assembly into a valve chamber defined in the plug assembly; reducing fluid pressure in the tubular above the plug assembly, creating a pressure differential between the valve chamber and the tubular above the plug assembly; axially moving an external valve sleeve on the plug assembly in response to the pressure differential; and in response to moving the valve sleeve, opening fluid communication between the tubular above the plug assembly and the tubular below the plug assembly. Further methods supported by the disclosure include a plug assembly having any, some or all of the following additional actions, in any combination: communicating pressure from the tubular below the plug assembly to the valve chamber through a one-way valve sub-assembly; wherein stopping the plug assembly further comprises landing the plug assembly on a downhole collar; wherein increasing the fluid pressure above the plug assembly further comprises running an integrity test of the tubular; wherein reducing fluid pressure above the plug assembly further comprises bleeding off pressure following the integrity test; at least one shearable member attaching the external sleeve to a valve body, and wherein moving the external sleeve further comprises shearing the at least one shearable member; after moving the external valve sleeve and opening fluid communication between the tubular above and below the plug assembly, retaining the external sleeve on a valve body of the plug assembly; wherein retaining the external sleeve further comprises attaching the external sleeve to a retention mechanism on the valve body; urging the external sleeve towards the open position with a biasing member; and/or wherein pushing a fluid ahead of the plug assembly further comprises pushing cement ahead of the plug assembly and into an annulus defined outside the tubular.

The embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps shown herein, other than as described in the claims.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A device for use in a wellbore, the device comprising:

a valve body having first and second ends, the first end being configured to removably affix to a plug component, the valve body defining an opening toward the first end and defining a port toward the second end, the valve body defining a passage extending between the port and the opening;

a piston being movable on the valve body from a first position to a second position, the piston defining a piston chamber;

a control valve disposed in communication between the wellbore and the piston chamber and being configured to capture wellbore pressure in the piston chamber as captured chamber pressure;

a closure disposed on the valve body and being configured to transition from a closed condition to an opened condition relative to the port in response to the movement of the piston, the closure in the closed condition preventing fluid communication through the port, the closure in the opened condition permitting fluid communication through the port; and a fixture releasably holding the closure in the closed condition on the valve body, the fixture being configured to release in response an increased pressure differential on the piston above an initial pressure differential between the captured chamber pressure and the wellbore pressure.

2. The device of claim 1, wherein the device further comprises a wiper plug for the plug component to which the valve body is configured to removably affix, the wiper plug having a head and a tail and defining an internal bore therethrough, the first end of the valve body of the device being removably affixable to the tail of the wiper plug, the opening toward the first end of the valve body communicating with the internal bore of the wiper plug, the head of the wiper plug comprising a seal and a catch configured to engage in a seat.

3. The device of claim 1, wherein the piston comprises a piston housing disposed on the valve body and enclosing the piston chamber with a portion of the valve body; and wherein the closure comprises a sleeve disposed on the valve body adjacent the piston housing, the fixture releasably affixing the sleeve to the piston housing.

4. The device of claim 3, wherein at least one of:

the device comprises a biasing element disposed between the piston housing and the sleeve, the biasing element biasing the sleeve from the closed condition toward the opened condition and biasing the piston housing from the first position toward the second position;

the fixture comprises one or more shearable elements connected between the sleeve and the piston housing, each of the one or more shearable elements being configured to shear in response to a force differential between the sleeve and the piston housing; and the fixture comprises one or more guide pins extending from the sleeve, each of the one or more guide pins being disposed in a slot defined on the valve body, the one or more guide pins and slots preventing movement of the piston housing, which is connected to the sleeve with the one or more shearable elements, from the first position to the second position.

5. The device of claim 1, wherein the piston comprises a housing portion disposed on the valve body and enclosing the piston chamber with a portion of the valve body; and wherein the closure comprises a sleeve portion extending from the housing portion of the piston and disposed about the valve body, whereby the movement of the housing portion from the first position to the second position moves the sleeve portion from the closed condition to the opened condition.

6. The device of claim 5, wherein at least one of:

the device comprises a biasing element disposed between the housing portion and the valve body, the biasing element biasing the housing portion from the first position toward the second position; and the fixture comprises one or more shearable elements connected between the piston and the valve body, each of the one or more shearable elements being configured to shear in response to a force differential between the piston and the valve body.

7. The device of claim 1, wherein the valve body comprises a stem extending from the second end of the valve body, wherein the piston comprises a housing movably disposed on and sealably engaged with the stem.

8. The device of claim 1, wherein the control valve comprises a check valve having an opened state and a closed state, the check valve in the opened state permitting e-pressure communication between the wellbore and the piston chamber, the check valve in the closed state preventing the pressure communication between the wellbore and the piston chamber, the check valve being configured to transition from the opened state to the closed state in response to a predetermined pressure level in the wellbore.

9. The device of claim 8, wherein at least one of:

the piston comprises a low-pressure volume disposed in communication with the check valve and configured to urge the check valve to the opened state, the low-pressure volume comprising a rupturable barrier separating the low-pressure volume from the wellbore and being rupturable in response to the predetermined pressure level in the wellbore; and the control valve further comprises an inlet valve disposed in communication between the piston chamber and the wellbore, the inlet valve being configured to permit the pressure communication from the wellbore into the piston chamber and being configured to prevent the pressure communication from the piston chamber out to the wellbore.

10. The device of claim 1, wherein the closure comprises a first portion of an external valve sleeve slidably attached to the valve body and being axially movable from the closed condition to the opened condition relative to the port, the first portion of the external valve sleeve in the closed condition preventing fluid communication through the port, the first portion of the external valve sleeve in the opened condition permitting fluid communication through the port;

wherein the piston comprises a second portion of the external valve sleeve having the piston chamber for retaining fluid pressure; and wherein the control valve comprises a first one-way valve providing pressure communication from the wellbore to the piston chamber, the first and second portions of the external valve sleeve being movable in response to the pressure differential between the piston chamber and the wellbore.

11. The device of claim 10, wherein at least one of:

the device further comprises a second one-way valve configured to provide pressure communication into the piston chamber from the passage of the valve body; and/or the device further comprises a biasing member biasing at least the first portion of the external valve sleeve towards the opened condition;

the first one-way valve is positioned in a stem extension of the valve body, the piston chamber being an annular valve chamber defined between the stem extension and the external valve sleeve; and the fixture comprises a shearable member attaching at least the first portion of the external valve sleeve to the valve body, the first portion of the external valve sleeve being movable to the opened condition upon shearing of the shearable member.

12. A system for cementing tubing in a wellbore, the tubing having a landing at a toe thereof, the system comprising:

a first plug being deployable in the tubing, the first plug having a head and a tail, the first plug defining a bore from the head to the tail, the head configured to engage with the landing; and a second plug having a device according to claim 1, the second plug being deployable in the tubing after the first plug and being configured to engage with the tail of the first plug.

13. A plug for use in a wellbore, the plug comprising:

a body having a head and a tail, the body defining a passage extending from a port toward the tail to an opening toward the head;

a piston housing movably disposed on the tail of the body from a first position to a second position and enclosing a piston chamber therewith;

a control valve disposed in communication with the piston chamber and having an opened state and a closed state, the control valve in the opened state permitting pressure communication between the wellbore and the piston chamber, the control valve in the closed state preventing the pressure communication between the wellbore and the piston chamber;

a low-pressure volume disposed in communication with the control valve and configured to urge the control valve to the opened state;

a rupturable barrier separating the low-pressure volume from the wellbore and being rupturable in response to a predetermined pressure level in the wellbore, the control valve being configured to transition from the opened state to the closed state in response to the rupture of the rupturable barrier, the piston housing being urged from the first position to the second position in response to a pressure differential between chamber pressure in the pressure chamber and wellbore pressure in the wellbore;

a closure being movable from a closed condition to an opened condition relative to the port, the closure in the closed condition preventing fluid communication through the passage, the closure in the opened condition permitting fluid communication through the passage;

a biasing element disposed between the piston housing and the closure, the biasing element biasing the closure toward the opened condition and biasing the piston housing toward the second position; and a fixture releasably affixing the closure to the piston housing, the fixture initially holding the closure in the closed condition and preventing the movement of the piston housing from the first position to the second position, the fixture being configured to release in response to the movement of the piston housing from the first position to the second position due to the pressure differential increased above an initial level.

14. A plug for use in a wellbore, the plug comprising:

a body having a head and a tail, the body defining a passage extending from a port toward the tail to an opening at the head;

a piston movably disposed on the tail of the body, the piston having a closure portion and a housing portion, the housing portion defining a piston chamber with a portion of the body, the closure portion being movable from a closed condition to an opened condition relative to the port, the closure portion in the closed condition preventing fluid communication through the passage, the closure portion in the opened condition permitting fluid communication through the passage;

a control valve disposed in communication with the piston chamber and having an opened state and a closed state, the control valve in the opened state permitting pressure communication between the wellbore and the piston chamber, the control valve in the closed state preventing the pressure communication between the wellbore and the piston chamber, the control valve being configured to transition from the opened state to the closed state in response to a predetermined pressure level in the wellbore;

a low-pressure volume disposed in communication with the control valve and configured to urge the control valve to the opened state;

a rupturable barrier separating the low-pressure volume from the wellbore and being rupturable in response to a predetermined pressure level in the wellbore, the control valve being configured to transition from the opened state to the closed state in response to the rupture of the rupturable barrier, the closure portion of the piston being urged from the closed condition to the opened condition in response to a pressure differential between chamber pressure in the pressure chamber and wellbore pressure in the wellbore;

a biasing element disposed between the piston and the body, the biasing element biasing the closure portion toward the opened condition; and a fixture releasably affixing the piston to the body with the closure portion initially held in the closed condition, the fixture being configured to release in response to the movement of the piston due the pressure differential increased above an initial level.

15. A method of cementing tubing in a wellbore during a cementing operation, the method comprising:

landing a plug in the tubing during the cementing operation, the plug having a closure, a pressure chamber, and a fixture;

performing a pressure test by increasing tubing pressure in the tubing behind the landed plug and preventing, with the closure in a closed condition, communication through a passage in the landed plug;

controlling communication of the tubing pressure to the pressure chamber on the plug;

releasing a fixture in response to movement of the pressure chamber from a first position to a second position due to an increased pressure level in the pressure chamber; and permitting communication through the passage in the plug by permitting the closure to move from the closed condition to an opened condition in response to the release of the fixture.

16. The method of claim 15, initially comprising before landing the plug in the tubing:

initially pumping an initial plug separating an advancing fluid from a following fluid during the cementing operation, the initial plug having a bore therethrough, the bore having a seat and a temporary barrier therein;

landing the initial plug in the tubing; and permitting the following fluid to pass through the bore of the initial plug by breaching the temporary barrier of the initial plug.

17. A wiper plug for use in a wellbore, the wiper plug comprising:

a body having a head and a tail and having a wiper fin disposed thereabout, the body defining an opening toward the head and defining a port toward the tail, the body defining a passage extending between the port and the opening;

a piston being movable on the body from a first position to a second position, the piston defining a piston chamber;

a control valve disposed in communication between the wellbore and the piston chamber and being configured to capture wellbore pressure in the piston chamber as captured chamber pressure;

a closure disposed on the body and being configured to transition from a closed condition to an opened condition relative to the port in response to the movement of the piston, the closure in the closed condition preventing fluid communication through the port, the closure in the opened condition permitting fluid communication through the port; and a fixture releasably holding the closure in the closed condition on the body, the fixture being configured to release in response an increased pressure differential on the piston above an initial pressure differential between the captured chamber pressure and the wellbore pressure.

18. The wiper plug of claim 17, wherein the piston comprises a piston housing disposed on the body and enclosing the piston chamber with a portion of the body; wherein the closure comprises a sleeve disposed on the body adjacent the piston housing, the fixture releasably affixing the sleeve to the piston housing; and wherein the wiper plug comprises a biasing element disposed between the piston housing and the sleeve, the biasing element biasing the sleeve from the closed condition toward the opened condition and biasing the piston housing from the first position toward the second position.

19. The wiper plug of claim 17, wherein the piston comprises a housing portion disposed on the body and enclosing the piston chamber with a portion of the body; wherein the closure comprises a sleeve portion extending from the housing portion of the piston and disposed about the body, whereby the movement of the housing portion from the first position to the second position moves the sleeve portion from the closed condition to the opened condition; and wherein the wiper plug comprises a biasing element disposed between the housing portion and the body, the biasing element biasing the housing portion from the first position toward the second position.

20. The wiper plug of claim 17, wherein the control valve comprises a check valve having an opened state and a closed state, the check valve in the opened state permitting pressure communication between the wellbore and the piston chamber, the check valve in the closed state preventing the pressure communication between the wellbore and the piston chamber, the check valve being configured to transition from the opened state to the closed state in response to a predetermined pressure level in the wellbore; and wherein at least one of:

the piston comprises a low-pressure volume disposed in communication with the check valve and configured to urge the check valve to the opened state, the low-pressure volume comprising a rupturable barrier separating the low-pressure volume from the wellbore and being rupturable in response to the predetermined pressure level in the wellbore; and the control valve further comprises an inlet valve disposed in communication between the piston chamber and the wellbore, the inlet valve being configured to permit the pressure communication from the wellbore into the piston chamber and being configured to prevent the pressure communication from the piston chamber out to the wellbore.

21. The wiper plug of claim 17, wherein:

the closure comprises a first portion of an external valve sleeve slidably attached to the body and being axially movable from the closed condition to the opened condition relative to the port, the first portion of the external valve sleeve in the closed condition preventing fluid communication through the port, the first portion of the external valve sleeve in the opened condition permitting fluid communication through the port;

the piston comprises a second portion of the external valve sleeve having the piston chamber for retaining fluid pressure; and the control valve comprises a first one-way valve providing pressure communication from the wellbore to the piston chamber, the first and second portions of the external valve sleeve being movable in response to the pressure differential between the piston chamber and the wellbore.

22. The wiper plug of claim 21, wherein the wiper plug comprises at least one of:

a second one-way valve configured to provide pressure communication into the piston chamber from the passage of the body; and a biasing member biasing at least the first portion of the external valve sleeve towards the opened condition.

* * * * *